US010391340B2

(12) United States Patent
Aldino et al.

(10) Patent No.: US 10,391,340 B2
(45) Date of Patent: Aug. 27, 2019

(54) FIRE SUPPRESSION SYSTEM

(71) Applicant: Acell Industries Limited, Cork (IE)

(72) Inventors: Albertelli Aldino, London (GB); Michael Frieh, London (GB)

(73) Assignee: Acell Industries Limited, Cork, Co Cork (IE)

( * ) Notice: Subject to any disclaimer, the term of this patent is extended or adjusted under 35 U.S.C. 154(b) by 530 days.

(21) Appl. No.: 14/372,826

(22) PCT Filed: Jan. 18, 2013

(86) PCT No.: PCT/GB2013/050116
§ 371 (c)(1),
(2) Date: Jul. 17, 2014

(87) PCT Pub. No.: WO2013/108042
PCT Pub. Date: Jul. 25, 2013

(65) Prior Publication Data

US 2014/0352988 A1 Dec. 4, 2014

(30) Foreign Application Priority Data

Jan. 18, 2012 (GB) ..... 1200829.8

(51) Int. Cl.

| | |
|---|---|
| ***A62C 2/00*** | (2006.01) |
| ***A62C 2/06*** | (2006.01) |
| ***A62C 35/08*** | (2006.01) |
| ***A62C 5/00*** | (2006.01) |
| ***A62C 99/00*** | (2010.01) |

(52) U.S. Cl.
CPC ..... *A62C 2/06* (2013.01); *A62C 5/006* (2013.01); *A62C 35/08* (2013.01); *A62C 99/0018* (2013.01)

(58) Field of Classification Search
CPC ..... A62C 2/06; A62C 5/006; A62C 35/08; A62C 99/0018
USPC ..... 169/70, 12, 46, 54
See application file for complete search history.

(56) References Cited

U.S. PATENT DOCUMENTS

| | | | | |
|---|---|---|---|---|
| 3,217,456 | A * | 11/1965 | Quigg | E04B 1/944 52/255 |
| 4,557,961 | A * | 12/1985 | Gorges | B32B 3/12 428/117 |
| 5,610,359 | A * | 3/1997 | Spector | A62C 5/006 102/334 |
| 5,717,001 | A * | 2/1998 | Books | C08J 9/0019 521/146 |
| 2010/0170684 | A1 | 7/2010 | Richardson et al. | |

(Continued)

FOREIGN PATENT DOCUMENTS

| | | |
|---|---|---|
| EP | 2208511 | 7/2010 |
| GB | 1547568 | 6/1979 |
| JP | 2006271925 | 10/2006 |

OTHER PUBLICATIONS

PCT International Search Report dated Jan. 29, 2014.
Great Britain International Search Report dated May 10, 2012.

*Primary Examiner* — Viet Le
(74) *Attorney, Agent, or Firm* — Ryan T. Grace; Advent, LLP

(57) ABSTRACT

A panel (10) for use as a fire suppressing system which comprises a substrate (12) and an exothermic gas producing charge (14) wherein the exothermic gas producing charge (14) is integral with the substrate.

35 Claims, 14 Drawing Sheets

(56) References Cited

U.S. PATENT DOCUMENTS

2011/0027500 A1* 2/2011 Hanna ..... A62C 2/06
428/12

* cited by examiner

FIRE SUPPRESSION SYSTEM

The present invention relates to fire suppression panels and more specifically to fire suppression panels comprising exothermic gas producing charges. Also disclosed are methods of producing fire suppression panels and uses thereof as well as fire suppression To date nearly all commercial fire extinguishing methods consist of the use of pressurised systems, such as stored pressure or cartridge-operated, or sprinkler based systems.

Despite there being many types of fire extinguishers, most reply upon the use of a propellant such as air, nitrogen or carbon dioxide.

Typical extinguishing agents delivered using such methods include: dry chemical such as monoammonium phosphate, sodium bicarbonate, potassium bicarbonate and potassium chloride; foams such as aqueous film forming foam (AFFF), alcohol-resistant aqueous film forming foams (AR-AFFF) and compressed air foam systems (OAFS); water; wet chemical such as potassium acetate, potassium carbonate and potassium citrate; and clean agents such as halon (which has now been banned from use in Europe) and carbon dioxide.

Handheld fire extinguishers are more commonly used though require a person to be in close proximity to the naked flames, which may result in issues of personal safety. To date fire extinguishers can have horizontal range between 3 and 50 ft (when considering water, steam, gas, dry chemical and halon type fire extinguishers), or for gaseous based fire extinguishers, the range can be between 3 and 45 ft. The fire extinguishers which can produce the higher ranges require much heavier canisters (between 75 and 350 lbs). These weights are not easily managed in a hand held and have to be wheeled, and thus are not easily maneuvered in the event of a fire.

Sprinkler type systems (both water and gas) are also common, particularly for large buildings. However, a disadvantage with the use of such systems is that they require relatively large infrastructure, for example, all the sprinklers need to be fixed and piped. It will be appreciated that fitting such systems would be complicated during building of a new structure let alone an already constructed building. In addition, it is necessary to have large equipment storage areas, for example in the basement of the building to store the gas cylinders or for connecting the pipes to a mains supply of water. Such systems generally rely upon use of a thermo-sensitive system, which activates when triggered. Depending on the type of sprinkler the minimum ceiling temperature can vary from 38° C. to 329° C.

A further problem with such sprinkler systems is that there is a time delay, which in some instances can be two minutes, between activation of the system and deployment of the water or gas. It will be appreciated that the system cannot store gas or water in the pipes due to the pressures involved and/or issues of corrosion. Valuable time in suppressing a fire is therefore lost, especially in large buildings comprising many sprinklers and floors.

It will also be appreciated that such known systems, especially those which require the use of propellants and are therefore stored under high pressure, must be inspected regularly with pressure gauges and systems being checked for readiness and other issues such as corrosion.

Yet a further problem well known systems is that the fire suppressing materials can cause damage serious damage documents, equipment and goods as well as potentially the building itself. Given that such systems are routinely fitted in shops and offices they can leave premises unusable for many days after use, for example, as a result of water damage.

Accordingly, there is a need in the art to provide a system which reduces or alleviates one or more of the issues currently faced, particularly one which can be retrofitted into pre-existing constructions.

According to an aspect of the present invention there is provided a panel for use as a fire suppressing system comprising a substrate and an exothermic gas producing charge wherein the exothermic gas producing charge is integral with the substrate.

The term panel as used in the present application is intended to include panels which may be used to construct walls, floors, doors and/or ceilings. The panels may be modular in that they may be used with other panels (either those in accordance with the present invention or other suitable panels) to form walls, floors, doors and/or ceilings. It will be appreciated that the terms wall, floors and/or ceilings is intended to incorporate both load and non-load bearing structures. For example, the walls may be partitions such as used in large office buildings or cladding to cover existing structures. Likewise, the ceiling may be a false/hung ceiling such as found in many buildings.

The term integral as used in the present application is intended to mean that the exothermic gas producing charge is positioned within the substrate forming the panel. Such positioning preferably occurs during manufacture of the panel so that the exothermic gas producing charge is held by the substrate itself, for example within a defined void therein. In this way, the panel may be considered self-contained. It will be appreciated that the exothermic gas producing charge is not added as a retrofitting process to a pre-existing structure, such as within preinstalled panels within a building.

Suitable substrates for use in the present invention include those which are able to substantially withstand the heat produced by the exothermic gas producing charge. Preferably, the substrates are able to fully withstand the heat produced by the exothermic gas producing charge.

In addition, suitable substrates for use in the present invention include those which are able to substantially withstand the pressures generated by the gas producing charge. Preferably, the substrates are able to fully withstand the pressures generated by the gas producing charge.

The substrate materials may be foamed or unfoamed. In one embodiment, the material is a foamed resin.

The substrate materials may be porous or nonporous.

In one embodiment, the substrate is a porous material, for example, a porous material formed for one or more of the materials described above, such as a porous resin material.

Suitable substrate materials include, but are not limited to, polymers, zeolites, porous titanic material, ceramic material, sintered metals or silicon carbide.

However, in aspects of the invention the substrate is preferably a substantially rigid, self-supporting polymeric foam which is resistant to deflection under load and does not collapse under pressure. For example, the polymeric foam may be selected from phenolic resin foams, polystyrene foams, polyurethane foams, polyethylene foams, polyvinylchloride foams, polyvinylacetate foams, polyester foams polyether foams, and foam rubber. Preferably, the polymeric foam is selected from phenolic resin foams.

Preferably the substrate has a density in the range of 100 to 500 $kg \cdot m^{-3}$, more preferably 120 to 400 $kg \cdot m^{-3}$, and most preferably 120 to 250 $kg \cdot m^{-3}$, exclusive of any aggregate chips that may be embedded in the substrate.

The substrate may have a tensile strength in the range of 80 to 100 $N/m^2$.

For foamed materials, and without wishing to be bound by any particular theory, it is believed that the physical properties of such foams, especially the compressive strength and ability to withstand the pressures generated, are believed to be related to (amongst other factors) cell wall thickness and average cell diameter. Preferably, the average cell diameter of the foamed materials is in the range of about 0.5 mm to 5 mm, more preferably 0.5 or 1 mm to 2 or 3 mm. In addition, such foams may also be open-cell.

The cells or pores of the foamed substrate may be open to the exothermic gas producing charge. In a preferred embodiment, the cells or pores help to trap particulate matter which may be produced by the charge on activation. It will be appreciated that such a benefit prevents particulate matter from being ejected during fire suppression. Such particulates may be carbonaceous, sticky and oily residues which by their nature do not materially help to suppress a fire but rather can impede the intended effect. This is due to the fact that the particles may be incandescent, and when conveyed by the gases produced, can come into contact with documents, equipment and goods as well as potentially persons or the building itself. Whilst it is of course preferred to avoid damage to inanimate objects, it will be appreciated that it is highly important to avoid the potential to cause burns to persons or animals that may be in the vicinity of the panel.

Preferred materials for forming the substrate include foamed resins such as a phenolic foam. A surprising advantage in using such phenolic materials is that they are highly resistant to heat, such as that produced during combustion of the exothermic gas producing charge. Likewise, the material is surprisingly good at preventing heat transfer through the substrate to the extremities of the panel. This has obvious advantages in that the heat produced is retained within the panels thereby alleviating the possibility of people being burned and/or the panel aiding the fire to be suppressed.

A particularly suitable solid open-cell foam is a solid open-cell phenolic resin foam. For example, a suitable foam may be produced by way of a curing reaction between:

(a) a liquid phenolic resole having a reactivity number (as defined below) of at least 1; and (b) a strong acid hardener for the resole; optionally in the presence of:

(c) a finely divided inert and insoluble particulate solid which is present, where used, in an amount of at least 5% by weight of the liquid resole and is substantially uniformly dispersed through the mixture containing resole and hardener;

the temperature of the mixture containing resole and hardener due to applied heat not exceeding 85° C. and the said temperature and the concentration of the acid hardener being such that compounds generated as by-products of the curing reaction are volatilised within the mixture before the mixture sets such that a foamed phenolic resin product is produced.

By a phenolic resole is meant a solution in a suitable solvent of an acid-curable prepolymer composition prepared by condensation of at least one phenolic compound with at least one aldehyde, usually in the presence of an alkaline catalyst such as sodium hydroxide.

Examples of phenols that may be employed are phenol itself and substituted, usually alkyl substituted, derivatives thereof, with the condition that that the three positions on the phenolic benzene ring ortho- and para- to the phenolic hydroxyl group are unsubstituted. Mixtures of such phenols may also be used. Mixtures of one or more than one of such phenols with substituted phenols in which one of the ortho- or para-positions has been substituted may also be employed where an improvement in the flow characteristics of the resole is required. However, in this case the degree of cross-linking of the cured phenolic resin foam will be reduced. Phenol itself is generally preferred as the phenol component for economic reasons.

The aldehyde will generally be formaldehyde although the use of higher molecular weight aldehydes is not excluded.

The phenol/aldehyde condensation product component of the resole is suitably formed by reaction of the phenol with at least 1 mole of formaldehyde per mole of the phenol, the formaldehyde being generally provided as a solution in water, e.g. as formalin. It is preferred to use a molar ratio of formaldehyde to phenol of at least 1.25 to 1 but ratios above 2.5 to 1 are preferably avoided. The most preferred range is 1.4 to 2.0 to 1.

The mixture may also contain a compound having two active hydrogen atoms (dihydric compound) that will react with the phenol/aldehyde reaction product of the resole during the curing step to reduce the density of cross-linking. Preferred dihydric compounds are diols, especially alkylene diols or diols in which the chain of atoms between the hydroxy groups contains not only methylene and/or alkyl-substituted methylene groups but also one or more heteroatoms, especially oxygen atoms. Suitable diols include ethylene glycol, propylene glycol, propane-1,3-diol, butane-1,4-diol and neopentyl glycol. Particularly preferred diols are poly-, especially di-,(alkylene ether) diols, for example diethylene glycol and, especially, dipropylene glycol.

Preferably the dihydric compound is present in an amount of from 0 to 35% by weight, more preferably 0 to 25% by weight, based on the weight of phenol/aldehyde condensation product. Most preferably, the dihydric compound, when used, is present in an amount of from 5 to 15% by weight based on the weight of phenol/aldehyde condensation product. When such resoles containing dihydric compounds are employed in the present process, products having a particularly good combination of physical properties, especially strength, can be obtained.

Suitably, the dihydric compound is added to the formed resole and preferably has 2 to 6 atoms between hydroxy groups.

The resole may comprise a solution of the phenol/aldehyde reaction product in water or in any other suitable solvent or in a solvent mixture, which may or may not include water.

Where water is used as the sole solvent, it is preferably present in an amount of from 15 20 to 35% by weight of the resole, preferably 20 to 30%. Of course the water content may be substantially less if it is used in conjunction with a cosolvent, e.g. an alcohol or one of the above-mentioned dihydric compounds where used.

As indicated above, the liquid resole (i.e. the solution of phenol/aldehyde product 25 optionally containing dihydric compound) must have a reactivity number of at least 1. The reactivity number is 10/x where x is the time in minutes required to harden the resole using 10% by weight of the resole of a 66 to 67% aqueous solution of p-toluene sulfonic acid at 60° C. The test involves mixing about 5 mL of the resole with the stated amount of the p-toluene sulfonic acid solution in a test tube, immersing the test tube in a water bath heated to 60° C. and measuring the time required for the mixture to become hard to the touch. The resole should have a reactivity number of at least 1 for useful foamed products to be produced and preferably the resole has a reactivity number of at least 5, most preferably at least 10.

The pH of the resole, which is generally alkaline, is preferably adjusted to about 7, if necessary, for use in the process, suitably by the addition of a weak organic acid such as lactic acid.

Examples of strong acid hardeners are inorganic acids such as hydrochloric acid, sulphuric acid and phosphoric acid, and strong organic acids such as aromatic sulphonic acids, e.g. toluene sulphonic acids, and trichloroacetic acid. Weak acids such as acetic acid and propionic acid are generally not suitable. The preferred hardeners for the process of the invention are the aromatic sulfonic acids, especially toluene sulfonic acids. The acid may be used as a solution in a suitable solvent such as water.

When the mixture of resole, hardener and solid is to be poured, e.g. into a mould and in slush moulding applications, the amount of inert solid that can be added to the resole and hardener is determined by the viscosity of the mixture of resole and hardener in the absence of the solid. For these applications, it is preferred that the hardener is provided in a form, e.g. solution, such that when mixed with the resole in the required amount yields a liquid having an apparent viscosity not exceeding about 50 poises at the temperature at which the mixture is to be used, and the preferred range is 5 to 20 poises. Below 5 poises, the amount of solvent present tends to present difficulties during the curing reaction.

The curing reaction is exothermic and will therefore of itself cause the temperature of the mixture containing resole and acid hardener to increase. The temperature of the mixture may also be raised by applied heat, but the temperature to which said mixture may then be raised (that is, excluding the effect of any exotherm) preferably does not exceed 85° C. If the temperature of the mixture exceeds 85° C. before addition of the hardener, it is usually difficult or impossible thereafter to properly disperse the hardener through the mixture because of incipient curing. On the other hand, it is difficult, if not impossible, to uniformly heat the mixture above 85° C. after addition of the hardener.

Increasing the temperature towards 85° C. tends to lead to coarseness and non-uniformity of the texture of the foam but this can be offset at least to some extent at moderate temperatures by reducing the concentration of hardener. However at temperatures much above 75° C. even the minimum amount of hardener required to cause the composition to set is generally too much to avoid these disadvantages. Thus, temperatures above 75° C. are preferably avoided and preferred temperatures for most applications are from ambient temperature to about 75° C. The preferred temperature range usually depends to some extent on the nature of the particulate solid, where used. For most solids the preferred temperature range is from 25 to 65° C., but for some solids, in particular wood flour and grain flour, the preferred temperature range is 25 to 75° C. The most preferred temperature range is 30 to 50° C. Temperatures below ambient, e.g. down to 10° C. can be used if desired, but no advantage is usually gained thereby. In general, at temperatures up to 75° C., increase in temperature leads to decrease in the density of the foam and vice versa.

The amount of hardener present also affects the nature of the product as well as the rate of hardening. Thus, increasing the amount of hardener not only has the effect of reducing the time required to harden the composition, but above a certain level dependant on the temperature and nature of the resole it also tends to produce a less uniform cell structure. It also tends to increase the density of the foam because of the increase in the rate of hardening. In fact, if too high a concentration of hardener is used, the rate of hardening may be so rapid that no foaming occurs at all and under some conditions the reaction can become explosive because of the build up of gas inside a hardened shell of resin. The appropriate amount of hardener will depend primarily on the temperature of the mixture of resole and hardener prior to the commencement of the exothermic curing reaction and the reactivity number of the resole and will vary inversely with the chosen temperature and the reactivity number. The preferred range of hardener concentration is the equivalent of 2 to 20 parts by weight of p-toluene sulfonic acid per 100 parts by weight of phenol/aldehyde reaction product in the resole, assuming that the resole has a substantially neutral reaction, i.e. a pH of about 7. By equivalent to p-toluene sulfonic acid, we mean the amount of hardener required to give substantially the same curing time as the stated amount of p-toluene sulfonic acid. The most suitable amount for any given temperature and combination of resole and finely divided solid is readily determinable by simple experiment. Where the preferred temperature range is 25 to 75° C. and the resole has a reactivity number of at least 10, the best results are generally obtained with the use of hardener in amounts equivalent to 3 to 10 parts of p-toluene sulfonic acid per 100 parts by weight of the phenol/aldehyde reaction product. For use with temperatures below 25° C. or resoles having a reactivity number below 10, it may be necessary to use more hardener.

By suitable control of the temperature and of the hardener concentration, the time lapse between adding the hardener to the resole and the composition becoming hard (referred to herein as the curing time) can be varied at will from a few seconds to up to an hour or even more, without substantially affecting the density and cell structure of the product.

Another factor that controls the amount of hardener required can be the nature of the inert solid, where present. Very few are exactly neutral and if the solid has an alkaline reaction, even if only very slight, more hardener may be required because of the tendency of the filler to neutralize it. It is therefore to be understood that the preferred values for hardener concentration given above do not take into account any such effect of the solid. Any adjustment required because of the nature of the solid will depend on the amount of solid used and can be determined by simple experiment.

The exothermic curing reaction of the resole and acid hardener leads to the formation of by-products, particularly aldehyde and water, which are at least partially volatilised.

The curing reaction is effected in the presence of a finely divided inert and insoluble particulate solid which is substantially uniformly dispersed throughout the mixture of resole and hardener. By an inert solid we mean that in the quantity it is used it does not prevent the curing reaction.

It is believed that the finely divided particulate solid provides nuclei for the gas bubbles formed by the volatilisation of the small molecules, primarily formaldehyde and/or water, present in the resole and/or generated by the curing action, and provides sites at which bubble formation is promoted, thereby assisting uniformity of pore size. The presence of the finely divided solid may also promote stabilisation of the individual bubbles and reduce the tendency of bubbles to agglomerate and eventually cause likelihood of bubble collapse prior to cure. To achieve the desired effect, the solid should be present in an amount of not less than 5% by weight based on the weight of the resole.

Any finely divided particulate solid that is insoluble in the reaction mixture is suitable, provided it is inert. Examples of suitable particulate solids are provided above.

Solids having more than a slightly alkaline reaction, e.g. silicates and carbonates of alkali metals, are preferably avoided because of their tendency to react with the acid hardener. Solids such as talc, however, which have a very mild alkaline reaction, in some cases because of contamination with more strongly alkaline materials such as magnesite, are acceptable.

Some materials, especially fibrous materials such as wood flour, can be absorbent and it may therefore be necessary to use generally larger amounts of these materials than non-fibrous materials, to achieve valuable foamed products.

The solids preferably have a particle size in the range 0.5 to 800 microns. If the particle size is too great, the cell structure of the foam tends to become undesirably coarse. On the other hand, at very small particle sizes, the foams obtained tend to be rather dense. The preferred range is 1 to 100 microns, most preferably 2 to 40 microns. Uniformity of cell structure appears to be encouraged by uniformity of particle size. Mixtures of solids may be used if desired.

If desired, solids such as finely divided metal powders may be included which contribute to the volume of gas or vapour generated during the process. If used alone, however, it will be understood that the residues they leave after the gas by decomposition or chemical reaction satisfy the requirements of the inert and insoluble finely divided particulate solid required by the process of the invention.

Preferably, the finely divided solid has a density that is not greatly different from that of the resole, so as to reduce the possibility of the finely divided solid tending to accumulate towards the bottom of the mixture after mixing.

One preferred class of solids is hydraulic cements, e.g. gypsum and plaster, but not Portland cement because of its alkalinity. These solids will tend to react with water present in the reaction mixture to produce a hardened skeletal structure within the cured resin product. Moreover, the reaction with the water is also exothermic and assists in the foaming and curing reaction. Foamed products obtained using these materials have particularly valuable physical properties. Moreover, when exposed to flame even for long periods of time they tend to char to a brick-like consistency that is still strong and capable of supporting loads. The products also have excellent thermal insulation and energy absorption properties. The preferred amount of inert particulate solid is from 20 to 200 parts by weight per 100 parts by weight of resole.

Another class of solids that is preferred because its use yields products having properties similar to those obtained using hydraulic cements comprises talc and fly ash. The preferred amounts of these solids are also 20 to 200 parts by weight per 100 parts by weight of resole.

For the above classes of solid, the most preferred range is 50 to 150 parts per 100 parts of resole.

In general, the maximum amount of solid that can be employed is controlled only by the physical problem of incorporating it into the mixture and handling the mixture. In general it is desired that the mixture is pourable but even at quite high solids concentrations, when the mixture is like a dough or paste and cannot be poured, foamed products with valuable properties can be obtained.

Other additives may be included in the foam-forming mixture. These may include: (i) surfactants, such as anionic materials, e.g. sodium salts of long chain alkyl benzene sulfonic acids, non-ionic materials such as those based on poly(ethyleneoxide) or copolymers thereof, and cationic materials such as long chain quaternary ammonium compounds or those based on polyacrylamides; (ii) viscosity modifiers such as alkyl cellulose, especially methyl cellulose; and (iii) colorants, such as dyes or pigments. Plasticisers for phenolic resins may also be included provided the curing and foaming reactions are not suppressed thereby, and polyfunctional compounds other than the dihydric compounds referred to above may be included which take part in the cross-linking reaction which occurs in curing; e.g. di- or poly-amines, di- or poly-isocyanates, di- or poly-carboxylic acids and aminoalcohols. Polymerisable unsaturated compounds may also be included, possibly together with free-radical polymerisation initiators that are activated during the curing reaction, e.g. acrylic monomers, so-called urethane acrylates, styrene, maleic acid and derivatives thereof, and mixtures thereof. The foam-forming compositions may also contain dehydrators, if desired.

Other resins may be included e.g. as prepolymers which are cured during the foaming and curing reaction or as powders, emulsions or dispersions. Examples are polyacetals such as polyvinyl acetals, vinyl polymers, olefin polymers, polyesters, acrylic polymers and styrene polymers, polyurethanes and prepolymers thereof and polyester prepolymers, as well as melamine resins, phenolic novolaks, etc. Conventional blowing agents may also be included to enhance the foaming reaction, e.g. low boiling organic compounds or compounds which decompose or react to produce gases.

The exothermic gas producing charge, which may also be known as a solid propellant gas generator or an aerosol-forming composition, relies upon the formation of gases as a result of combustion of the charge.

The exothermic gas producing charge may be in the form of a paste, solid or powder.

Where the exothermic gas producing charge is in the form of a powder, it is preferably at least substantially retained within an envelope. The envelope may be formed by use of a further material such as paper or other suitable textile and/or by means of the walls of the substrate. For example, the walls of the substrate may substantially encase the exothermic gas producing charge.

Suitable materials for forming such charges include potassium nitrate and potassium carbonate.

With respect to the present invention, the use of potassium nitrate is preferred as its combustion temperature—i.e. the temperature at which it starts burning—(approximately 150° C.) is much lower than that of potassium carbonate (approximately 300° C.).

The exothermic gas producing charge used in the present invention may comprise up to 90% by weight of potassium carbonate or nitrate, and more preferably from 30 to 80% by weight. Suitable ranges also include 40 to 70% by weight.

The average particle size of the potassium carbonate or nitrate may be in the range of from 5 to 50 μm, such as from 15 to 30 μm.

In addition to the main components, the exothermic gas producing charge may comprise further components such as binders, burn rate modifiers, flame inhibition chemicals and/or additional oxidizing agents.

Suitable binding materials include guanidine salts or derivatives, such as aminoguanidine nitrate, guanidine nitrate, triaminoguanidine nitrate, diaminoguanidine nitrate and ethylenebis-(aminoguanidinium)dinitrate and resins such as phenolformaldehyde.

The binder may be present in amounts of up to 65% by weight, but is more generally present in amounts of from 5 to 55% by weight.

It will be appreciated that minor amounts of other binders may also be present, such as water-soluble organic binders. Suitable binders include guar gums, polyvinylpyrrolidone, polyacrylonitrile, polyvinylalcohol and water-soluble cellulose. Such other binders are generally used in an amount of 0 to 15% by weight, such as 1 to 5% by weight.

Suitable burn rate modifiers include powdered metals or their corresponding oxides, salts or complexes. Examples of such modifiers include, for example aluminium, bismuth, calcium, copper, hafnium, iron, magnesium, strontium, tin, titanium, tungsten, zinc and zirconium. As noted above also included are their respective oxides, salts and complexes.

The burn rate modifier may be present in amounts of 0 to 2% by weight, such as from 0.5 to 1.5% by weight.

It will be appreciated by those of skill in the art that the burn rate modifiers may be used individually, or in combination with one or more other burn rate modifiers.

Suitable flame inhibition chemicals include sodium bicarbonate, potassium bicarbonate, potassium carbonate, potassium chloride and monoammonium phosphate compounds.

Such compounds may be present in amounts of from 0 to 15% by weight, such as 5 to 10% by weight.

In the panels of the present invention, the exothermic gas producing charge is preferably positioned within a void formed in the substrate. As used herein, the term "void" is refers to a substantially enclosed cavity or chamber within the substrate of the panel. It will be appreciated that the void must be in fluid contact with the outside of the panel to allow ejection of gas produced by the exothermic gas producing charge.

The use of a substantially enclosed cavity or chamber within the substrate of the panel is preferred as it allows temperatures in excess of 500° C., preferably in excess of 650° C. and more preferably in excess of 850° C. to be produced within the void upon combustion of the exothermic gas producing charge. Such a temperature allows, at least partly, for the decomposition of by-products produced by the exothermic gas producing charge.

The substrate may comprise one or more further substrates. The one or more further substrates may be used to form a wall of the void. The one or more further substrates may have a void therein which is complementary to the void in the substrate.

By way of example, a panel in accordance with the present invention may comprise:

(i) a first substrate having at least one opening extending through the entire thickness of the substrate;

(ii) an exothermic gas producing charge within the opening; and (iii) second and third substrates sandwiching the first substrate.

By sandwiching the first substrate between the second and third substrates a void is formed which contains the exothermic gas producing charge. The second and/or third substrate may additionally have a void therein which is complementary to the void in the first substrate.

It will be appreciated that the substrate may comprise a plurality of voids. Where the substrate comprises a plurality of voids, one or more of the voids may contain exothermic gas producing charge.

In addition, it will be appreciated that the exothermic gas producing charge may be present as a single charge within a void, or as a plurality of charges within a single void. For example, the exothermic gas producing charge may be present as two or more charges, with three, four, five or more separate charges being contemplated.

Preferably, the plurality of voids is distributed in a two-dimensional array in the direction perpendicular to the panel thickness.

An internal surface of the void may comprise a suitable heat resistant material and/or layer so as to increase the heat resistance of the panel upon combustion of the exothermic gas producing charge. Examples of materials which may be incorporated into the one or more fire retardant layers include rock wool, gypsum, perlite, vermiculite, alumina, aluminium hydroxide, magnesium hydroxide, and calcium silicate. Gypsum is considered to be particularly preferable.

The exothermic gas producing charge may be stored within a casing so as to prevent it coming into contact with water (the term 'water' is intended to include all types of moisture such as humidity within the atmosphere) and for example excess amounts of dust. Such a casing is preferably combustible. For example, the casing could be a paper material, such as a waxed paper.

It will also be appreciated that where the substrate is formed from a porous material, the gas producing charge may be contained within one or more of the pores of the substrate. Such a structure may be obtained by coating the surface of the porous substrate with the exothermic gas producing charge, for example, when it is in the form of a paste or a powder.

In principle, the exothermic gas producing charge may also be used to coat the surface of the substrate.

The amount of exothermic gas producing charge which is contained within the void or voids is dependent on many factors, such as how much gas is needed, the speed with which the gas needs to be emitted and also the distance which the gas needs to travel. Selecting the required amount can be undertaken by a person of skill in the art.

However, it will be noted that the amount used should be sufficient to create a pressure within the void in the substrate of the panel (i.e. the void may be considered a pressure chamber) such that the gas being ejected travels distances of up to 30 feet. Distances of up to 10 feet or 20 feet are also suitable depending on the fire suppressing requirements for the panel.

The rate at which gas may be produced by the exothermic gas producing charge is at least partially controlled through the surface area of the exothermic gas producing charge within the void. It will be appreciated that increasing the surface area increases the rate at which the fire suppressing gas may be formed. In this way, rate at which the fire suppressing gas is produced, the pressure within the void and/or the distance at which the fire suppressing gas is dispensed and the duration of its ejection may be controlled.

Due to the pressures being generated by the exothermic gas producing charge within the void/pressure chamber, it is an option to provide means for reinforcing the void/pressure chamber. Such reinforcing means may be in addition to a heat resistant layer on a surface of the substrate forming the void, as discussed above. The reinforcing means may comprise fibres such as described herein. In addition, or alternatively, such reinforcing means may comprise a casing constructed from a suitable material. The case preferably substantially surrounds the void/pressure chamber. Suitable materials include plastics and metals, and can be readily selected by a person of skill in the art.

The void may be formed solely by the walls of a single substrate, or by the joining of one or more individual substrates to form a single substrate, for example, by use of suitable adhesives. Where more than a single substrate is used to form the void, it will be appreciated that the further substrate can be made of a material identical to or different from that of a first substrate.

Where more than a single substrate is used to form the void, the substrates may be bonded to one another by means of suitable adhesives. Such adhesives, may include, but are not limited to natural rubber, synthetic polyisoprene, butyl rubber, halogenated butyl rubber, polybutadiene, styrene-butadiene rubber, nitrile rubber, hydrogenated nitrile rubber, chloroprene rubber, silicone rubber, and halogenated silicone rubber.

It will be appreciated that the void containing the exothermic gas producing charge is in fluid communication with the outside of the panel by way of a channel. In this way, the gas produced by the exothermic gas producing charge can be ejected from the panel. The panel may comprise a single channel or a plurality of channels depending on the function of the panel. For example, the panel may comprise from 1 to 20 channels, including 2 to 16, 4 to 12 and 6 to 10, for example 8.

Such fluid communication can be provided by way of a pore or pores within the substrate. Alternatively, or in addition, such fluid communication can be provided by a passage or passages within the substrate.

Still further, a nozzle or nozzles made of suitable materials (for example metals or plastics) may be used to provide channels within the substrate or in addition to pores and/or passages within the substrate.

Where present, the nozzles may be located within the panel such that they do not extend beyond an outer surface of the panel. As such the nozzles may be flush with an outer surface of the panel or positioned within a channel/passage of the panel.

Alternatively or in addition, the nozzles may extend beyond an outer surface of the panel. The nozzles may be positioned within a channel/passage of the panel.

It will be appreciated that combinations of channels, passages and/or nozzles may be used as appropriate, depending on the intended use of the panel.

It will be understood that the number of channel or channels required is dependent on a number of factors, for example the intended use of the panel (floor, ceiling, wall and/or door), the distance that the ejected gas needs to travel (relating to the pressure in the void) and the rate/volume of gas which needs to be released (relating to the number of channels, pressure and amount of exothermic gas producing charge).

It will be appreciated by those of skill in the art that the channels may be positioned so as to direct the gas in a particular direction. That is the angle of the channels may be such as to eject the gas in a particular direction on exit. In this way the gas being ejected from a panel can be aimed, for example to direct the gas from a wall panel towards a floor surface, or from a wall panel towards a ceiling. By way of further example, for a ceiling panel the channels could direct the ejected gas towards a wall or both a wall and floor surface. Nozzles may be used to aid in the directing of the gas.

Such directing of the gas also makes it possible to improve the ease of evacuation from a room. For example, the gas can be directed initially to floor level so as to provide any persons within the room with extra seconds to see their possible exits.

Additionally, the channels may be shaped so as to increase or decrease the pressure of the gas being ejected. It will be appreciated that tapering the channel to become smaller as the gas moves from the void will increase the pressure of the gas, and for example, increase the distance it travels. Like wise, tapering the channel to become bigger as the gas moves from the voids will, for example, decrease the pressure of the gas and also increase the amount released.

In a preferred embodiment, the channels are offset from the exothermic gas producing charge. By offset it is meant that there is no direct line of sight from the channel to the exothermic gas producing charge. A benefit of such an embodiment is that it prevents any flames and/or sparks from the combusted exothermic gas producing charge from being ejected. Such an embodiment also helps to reduce ejection of the particulates which may be carbonaceous, sticky and oily residues which by their nature do not materially help to suppress a fire but rather can impede the intended effect (see comments above regarding such particles).

In a further embodiment, the channels may be located on opposite sides of the panel. In this way, gas may be ejected from at least two sides of the panel. Such an embodiment is particularly beneficial where the panels are used to form a hung ceiling (also known as drop ceiling, false ceiling or suspended ceiling). With such ceilings, it is possible for a fire start both above and/or below the ceiling as there is an airspace above the ceiling structure. It will be appreciated that by having channels located on both sides of the panel, it is possible to suppress a fire above the ceiling structure. Similar comments apply to raised floors (also known as access flooring).

In an embodiment of the present invention, it may be necessary to seal the panel so as to prevent unwanted ejection of gas. Such unwanted ejection can occur from either one or more pores in a foamed substrate and/or where one or more substrates have been joined to form a void.

Where the pores of the substrate are open to the surface, a sealant may optionally be applied, and preferably the pores open out below the surface to a greater width than the opening, thereby providing an undercut which can enhance the keying of the sealing material to the porous substrate.

The air-tight sealing coating is provided over the peripheral surfaces of the panel substrate so as to hermetically seal the panel. The air-tight sealing coating preferably penetrates at least a portion of the porous substrate. For example, the air-tight sealing coating may penetrate the porous substrate to a depth which is at least equivalent to the average cell diameter of the porous substrate, more preferably to a depth which is at least two times the average cell diameter of the porous substrate. Alternatively, the air-tight sealing coating may penetrate the porous substrate to a depth of at least 0.5 mm, more preferably at least 1.0 mm, and still more preferably at least 2.0 mm, for example at least 2.5 mm or at least 3.0 mm.

The air-tight sealing coating preferably comprises or consists of one or more elastomers. Preferably, the air-tight sealing coating comprises or consists of at least one elastomer selected from: natural rubber, synthetic polyisoprene, butyl rubber, halogenated butyl rubber, polybutadiene, styrene-butadiene rubber, nitrile rubber, hydrogenated nitrile rubber, chloroprene rubber, silicone rubber, and halogenated silicone rubber.

In a further embodiment, the panel may be coated (by coated it is meant substantially coated, i.e. the majority of the outer-surfaces are coated with a skin, and preferably substantially all of the outer surfaces are coated) in a skin which may be used to seal the panel so as to prevent the ejection of gas from either one or more pores in a foamed substrate and/or where one or more substrates have been joined to form a void.

The skin may be applied using an adhesive layer, thermal bonding, pressure or mechanical securing means.

Suitable materials for forming the skin include sheet-form polymeric material and gypsum. For the present invention, gypsum is particularly preferred as it is also heat resistant. Such a property is of course desired due to use of an exothermic gas producing charge. An additional advantage is that gypsum produces an outer surface which is comparable to drywall or plasterboard.

The sheet-form polymeric material preferably comprises a matrix comprising or consisting of a thermosetting polymer resin, for example, a thermosetting polymer resin matrix selected from polyester resins, vinyl ester resins, epoxy resins, phenolic resins, bismaleimide resins or polyimide resins. Most preferably, the sheet-form polymeric material comprises a thermosetting polymer resin matrix selected from polyester resins. The sheet-form polymeric material may also include melamine, which is useful as a fire retardant. The sheet-form polymeric material may further include additives selected from hardeners, accelerators, fillers, pigments, and/or any other components as required.

Whichever skin material is used, it is preferable, where the substrate is a porous material, for the skin material to a depth which is at least equivalent to the average cell diameter of a pore, more preferably to a depth which is at least equivalent to two times the average cell diameter of a pore. Alternatively, the skin material may penetrate the porous substrate to a depth of at least 0.5 mm, more preferably at least 1.0 mm, and still more preferably at least 2.0 mm, for example 2.5 mm or 3.0 mm.

In this way, the skin material forms a skin on the porous substrate which is mechanically keyed into the surface of the porous substrate. By "mechanically keyed" it is meant that at least a portion of the skin material penetrates at least a portion of the porous substrate and forms a mechanical interaction with the porous substrate. Thus, at least a portion of the skin material becomes effectively entrapped within the outer cells of the porous substrate to form a strong mechanical bond. In this way, a stable monolithic layered composite structure may be obtained without the need for an adhesive to be applied between the layers.

In a further embodiment, the panels of the invention may further comprise one or more reinforcing layers to provide additional strength, rigidity and/or pressure-resistant capacity to the panels.

By way of example, the panel may comprise reinforcing fibres. The panel may be wrapped in such fibres so as to provide additional strength, rigidity and/or pressure-resistant capacity to the structure. This may be particularly beneficial due to the high pressures generated by the exothermic gas producing charge once activated.

The fibres may be included, for example, before or after the application of a sealing coating. Likewise, the fibres may be included, for example, before or after the application of a skin layer. In yet another embodiment, the fibres may be within the skin material. It will be appreciated that combinations of the aforementioned embodiments may be used.

The fibres may include one or more materials. For example the fibres may include one or more of carbon fibres, glass fibres, aramid fibres and/or polyethylene fibres, such as ultra-high molecular weight polyethylene (UHMWPE). In one preferred embodiment, the reinforcement comprises or consists of glass fibres, for example E-glass fibres or S-glass fibres.

The reinforcing fibres may be short fibres, for example having lengths of 5.0 cm or less, or may be longer fibres. The fibres may be loose, for example, the fibres may be arranged in a uni- or multi-directional manner. The fibres may be part of a network, for example woven or knitted together in any appropriate manner. The arrangement of the fibres may be random or regular, and may comprise a fabric, mat, felt or woven or other arrangement. Fibres may provide a continuous filament winding. Optionally, more than one layer of fibres may be provided.

In a preferred embodiment, one or both faces of the panel may have a profiled surface. For example, one or both faces of the panel may have a profiled surface formed by a moulding technique. Where a profiled surface is used, it is preferably formed on a surface which is visible when the panel is in use. In this way, the aesthetic effect of the panels of the invention may be improved, and the function of the panels may be disguised for aesthetic and security reasons.

In some examples, an outer surface of the panel may optionally be bonded to a surface effect material. The surface effect material may be selected so as to provide the panel with, for example, a simulated stone surface, a simulated brick surface, a simulated wood surface, a wood laminate surface, a material of high thermal conductivity (a "cool touch" surface), or a reflective surface. For example, granular material, such as sand or metal granules, a veneer element, such as a wood veneer element, a brick veneer element, a stone veneer element, or a metallic foil/metallic particles can be bonded to, or partially embedded into the surface of the sheet form polymeric material. Different surface effects can be obtained by selection of the types of surface effect materials that are used.

It will be appreciated that the panels of the present invention will likely be retained in place for many years without any use. It is therefore preferable to prevent any ingress of dust and/or water into the channels of the panel. Accordingly, in one embodiment it is preferred to seal the channels of the panel. It will of course be understood that the channels are not sealed in a way which would prevent the ejection of gas on activation of the exothermic gas producing charge. Such a seal can take the form of a wax or polymer. Such a seal can also take the form of a cap or bung inserted in the channel.

A further benefit of sealing the panel (and also the exothermic gas producing charge) is that it significantly increases the shelf-life of the panel. This is partly due to the fact that the exothermic gas producing charge, in some embodiments, may be moisture sensitive.

Depending on the type of exothermic gas producing charge which is used in the panels of the present invention, the charge may produce minor amounts of toxic and/or corrosive substances. Such substances may include ammonia, carbon monoxide and carbon dioxide.

In a preferred embodiment the panel further comprises an adsorbent material which can be used to selectively remove the toxic and/or corrosive substances produced before the fire suppressant gas is ejected from the panel.

Materials which would be suitable for the adsorption of, for example ammonia, include activated carbon, covalent organic frameworks (COFs), zeolites, mesoporous silica material (Al-MCM-41), graphite oxide/Al13 composites, micro/mesoporous activated carbons modified with molybdenum and tungsten oxides, activated carbon modified with $V_2O_5$, manganese oxide and graphite oxide/$MnO_2$ composites.

Materials which would be suitable for the adsorption of, for example carbon monoxide, include zeolites, copper based catalysts, $Cu^+$ or $Ag^+$ containing alumina, polystyrene resin containing amino groups and copper (I) chloride, and activated alumina.

Materials which would be suitable for the adsorption of, for example carbon dioxide, amine modified SBA-15, ordered mesoporous silicas, organosilicas, COFs, polyethylamine modified MCM-41, hydrotalcites and polymeric membranes.

The absorbent material may be located within the void so as to remove the toxic and/or corrosive substances as they are produced. Alternatively, or in addition, the absorbent material may be located within the channels.

Where the substrate is porous, the absorbent material may be retained in the pores of the substrate. As noted above, such pores are also beneficial in capturing particulate matter.

The absorbent material may also be retained on a porous material, different to the substrate. In such an embodiment, the porous material different to the substrate may be located within the void and/or channels. Again, the pores of such a material are beneficial in capturing particulate matter and preventing its ejection from a panel.

Alternatively, or in addition, the panel may comprise a filter. The filter may be used to remove the toxic and/or corrosive substances that are produced. Alternatively, or in addition, the filter may be used to remove particulate matter from the gas produced by the exothermic gas producing charge.

The filter may take the form of a porous material located in the void or channel, such as a porous material comprising one or more of the absorbent materials discussed above.

Whilst the exothermic gas producing charge can, in principle, be activated by the high temperatures of a fire, it is preferred for the panel to comprise an igniter for the exothermic gas producing charge. Such igniters may also be known as activators. Such devices are well known in the art and may be readily selected by persons of skill in the art. The use of an igniter material is also contemplated.

Ideally, in the panels of the present invention, there is no delay between activation and combustion of the exothermic gas producing charge. Preferably, any delay that there is less than 3 seconds, preferably less than 2 seconds and most preferably less than 1 second.

The panels of the present invention may have a thickness of from 1 to 50 cm, more preferably from 2 to 40 cm. In further preferred embodiments, the panels of the invention may have a thickness of from 2 to 5 cm, from 5 to 10 cm, from 10 to 20 cm, from 20 to 30 cm, or from 30 to 40 cm.

The length and width of the panels are not particularly limited and may each take a range of values, for instance in the range of from 20 to 10,000 cm, for example from 50 to 5,000 cm. Multiplying the length by the width provides the surface area of the panels, which as used herein refers to the surface area of a single face of the panel.

It will be appreciated that the size of the panel will depend on the end use of the panel. In general panels having greater length and width will also have greater thickness so as to maintain a functional level of rigidity of the panel.

As already discussed above, in use, the panels of the present invention may be used to construct walls, floors, doors and/or ceilings. The panels may be modular in that they may be used with other panels (either those in accordance with the present invention or other suitable panels) to form walls, floors, doors and/or ceilings. It will be appreciated that the terms wall, floors and/or ceilings is intended to incorporate both load and non-load bearing structures. For example, the walls may be partitions such as used in large office buildings or cladding to cover existing structures. Likewise, the ceiling may be a false/hung ceiling such as found in many buildings.

In addition, it will be appreciated that the panels of the present invention may be used in conjunction with suitable fixing means, for example, suitable clips or brackets. Such fixing means may aid in the connecting of the panels to form structures and/or the connecting of the panels to pre-existing structures. The fixing means may also be located at least partially within the panels. The fixing means may be located or connected to the panels at any stage during their construction, such as a method as described below.

In this way, the panels of the present invention, as described above, may be used to produce fire suppression systems. Accordingly, the present invention provides a fire suppression system comprising a panel as described above.

The present invention also includes the use of a panel substantially as described herein in a fire suppression system, as well as a fire suppression system comprising a panel substantially as described herein.

Preferably, term fire suppression includes substantially extinguishing the fire, more preferably fully extinguishing the fire.

Such systems will generally comprise a panel in accordance with the present together with a fire detection system. Such systems are generally known in the art, and by way of example, one is disclosed in further detail below. In general however, such systems are able to detect fires and/or parameters indicative of potential problems, and to react accordingly, for example, by activating panels which are located in a particular area.

In general, a fire suppression system in accordance with the present invention will comprise at least a panel substantially as described above, a detector and means for activating the panel. It will be appreciated that the means for connecting the devices are all well within the knowledge of the person of skill in the art and do not require further disclosure herein. However, by way of example, such a system is described below.

In a preferred embodiment, gas is released from the panels in less than 30 seconds from the detection of a fire (or parameters indicative of potential problems), preferably less than 15 seconds, more preferably less than 5 seconds, even more preferably less than 3 seconds and most preferably less than 1 second.

The fire suppression system of the present invention may also comprise the use of a fan to aid in the dispersing and directing of the gas produced by the exothermic gas producing charge. The fan may be located within one of the panels, but it is not essential.

The fan may be used to blow the gas to a particular location, or to prevent the gas produced from blocking a person's view of the exit from a room. By way of example, a fan may be used to keep the gas produced at floor level, i.e. within a few feet of the floor, thereby allowing a clear view of any exits from a room.

A fire suppression system in accordance with the present invention has particular applicability in buildings with are being retrofitted—i.e. those where there is a pre-existing structure and it would be difficult to introduce, for example, known sprinkler systems such as those described above.

A fire suppression system in accordance with the present invention also has particular applicability in the oil industry. There are areas within oil refineries which are more likely to be affected by fire. The present invention can be used to target these areas in the absence of professional fire fighters. In addition, such fire suppression systems are particularly useful for offshore rigs and ships where space is at a premium.

Additionally, as the panels of the present invention may be made of lightweight materials such as phenolic foams, "shields" can be made from the panels for use by, for example, fire-fighters. Such shields may contain multiple voids containing exothermic gas producing charge which can be activated through either manual or automatic means.

In yet another aspect of the present invention there is provided a method of suppressing a fire comprising the step of activating a panel substantially as described above.

Preferably, the method of suppressing the fire includes the step of substantially extinguishing the fire, more preferably fully extinguishing the fire.

A panel in accordance with the present invention may be prepared by a method comprising the steps of:

(i) providing a substrate;
(ii) forming a void therein; and
(iii) positioning an exothermic gas producing charge within the void.

Alternatively, a panel in accordance with the present invention may be prepared by a method comprising the steps of:

(i) providing a substrate having at least one void provided therein; and
(ii) positioning an exothermic gas producing charge within the void.

In either of the methods detailed above for producing a panel in accordance with the present invention, a further step may comprise providing one or more further substrates. The one or more further substrates may be used to form a wall of the void. The one or more further substrates may have a void therein which is complementary to the void in the substrate.

By way of example, a panel in accordance with the present invention may also be prepared by a method comprising the steps of:

(i) providing a first substrate having at least one opening extending through the entire thickness of the substrate;
(ii) positioning an exothermic gas producing charge within the opening; and
(iii) sandwiching the first substrate between second and third substrates.

By sandwiching the first substrate between the second and third substrates a void is formed which contains the exothermic gas producing charge. The second and/or third substrate may additionally have a void therein which is complementary to the void in the first substrate.

The substrate may be selected from any of those described above.

The void and/or opening in the substrate may be made using known means. Moulding, pressing and other mechanical forming means are contemplated for this invention.

As described above for the panels of the present invention, a plurality of voids may be used. Likewise, for the method described above, the first substrate may comprise a plurality of openings.

Where there is a plurality of voids/openings, they are preferably arranged in a two-dimensional array such as described above.

The exothermic gas producing charge may be selected from any of those described above. The exothermic gas producing charge may be positioned whilst in the form of a powder, paste or solid.

Where the exothermic gas producing charge is positioned in the form of a paste, it may be desirable to 'solidify' it once positioned. Such solidifying steps may include drying, curing and/or binding the paste.

Likewise, where the exothermic gas producing charge is positioned in the form of a powder, it may be desirable to 'solidify' it once positioned. Such solidifying steps may include binding, curing and/or drying the paste.

In a further step, one or more fire retardant and/or heat resistant layers may be applied to an internal surface of the void (or opening). Such a layer may be applied using known means.

Examples of materials which may be incorporated into the one or more fire retardant layers include rock wool, gypsum, perlite, vermiculite, alumina, aluminium hydroxide, magnesium hydroxide, and calcium silicate. Gypsum is considered to be particularly preferable.

The void may be formed solely by the walls of a single substrate, or by the step of joining of one or more individual substrates to form a single substrate, for example, by use of suitable adhesives such as those described above. In this way, the method of forming a fire suppressing panel in accordance with the present invention contemplates the step of applying an adhesive (preferably in the form of a layer) to bond one or more substrates. Whilst it is preferable to only bond the substrates together once all desired components of the panel have been provided, it will be appreciated that the step of applying the adhesive may be done at any suitable time within the process of preparing a panel in accordance with the present invention. By way of example, the substrates could be bonded together to form a void followed by the step of adding the exothermic gas producing charge.

Where more than a single substrate is used to form the void, it will be appreciated that the further substrate can be made of a material identical to or different from that of a first substrate.

The method of preparing a panel in accordance with the present invention may also comprise the step of forming a channel (such as those described above) so as to allow the void containing the exothermic gas producing charge to be in fluid communication with the outside of the panel. Such a step may comprise forming a single channel or a plurality of channels depending on the function of the panel. For example, it may be required to form from 1 to 20 channels, including 2 to 16, 4 to 12 and 6 to 10, for example 8.

Such channels may be formed by use of known methods in the art, and are well within the knowledge of persons of skill in the art. It will be appreciated that such channels may be formed before or after bonding of the substrates. It will also be appreciated that such channels can in principle be formed at any stage during preparation of the panel.

Such channels may also be provided by way of a pore or pores within the substrate.

A nozzle or nozzles made of suitable materials may be used to provide the channels within the substrate or in addition to pores and/or passages within the substrate. Such nozzles may be retained in place by use of suitable adhesives and/or friction fittings. He nozzles may be applied to the panel at any suitable time during preparation, depending on the intended purpose.

The preparation method of a panel in accordance with the present invention may further comprise the step of sealing the panel so as to prevent the ejection of gas from either one or more pores in a foamed substrate and/or where one or more substrates have been joined, such as to form a void.

The sealant may be applied using known means.

The air-tight sealing coating is applied over the peripheral surfaces of the substrate so as to hermetically seal the panel. Preferably, the air-tight sealing coating is applied so as to penetrate at least a portion of the porous substrate. For example, the air-tight sealing coating may penetrate the porous substrate to a depth which is at least equivalent to the average cell diameter of the porous substrate, more preferably to a depth which is at least two times the average cell diameter of the porous substrate. Alternatively, the air-tight sealing coating may penetrate the porous substrate to a depth of at least 0.5 mm, more preferably at least 1.0 mm, and still more preferably at least 2.0 mm, for example at least 2.5 mm or at least 3.0 mm.

The air-tight sealing coating preferably comprises or consists of one or more elastomers such as those described above.

In a further embodiment, the method of preparing a panel may comprise the step of coating the substrate in a skin which may be used to seal the panel so as to prevent the ejection of gas from either one or more pores in a foamed substrate and/or where one or more substrates have been joined to form a void.

The skin may be applied using an adhesive layer, thermal bonding, pressure or mechanical securing means.

Suitable materials for forming the skin are as described above.

Which ever skin material is used, it is preferable, where the substrate is a porous material, for the skin material to be applied to a depth which is at least equivalent to the average cell diameter of a pore, more preferably to a depth which is at least equivalent to two times the average cell diameter of a pore. Alternatively, the skin material may penetrate the porous substrate to a depth of at least 0.5 mm, more preferably at least 1.0 mm, and still more preferably at least 2.0 mm, for example 2.5 mm or 3.0 mm.

In this way, the skin material forms a skin on the porous substrate which is mechanically keyed into the surface of the porous substrate. By "mechanically keyed" it is meant that at least a portion of the skin material penetrates at least a portion of the porous substrate and forms a mechanical interaction with the porous substrate. Thus, at least a portion of the skin material becomes effectively entrapped within the outer cells of the porous substrate to form a strong mechanical bond. In this way, a stable monolithic layered composite structure may be obtained without the need for an adhesive to be applied between the layers.

It will be appreciated that the skin may be applied after formation of the panel, for example after positioning of the exothermic gas producing charge and/or bonding of the one or more substrates. However, it is also possible to apply the skins to outer surfaces of the substrates prior to, for example, positioning of the exothermic gas producing charge and/or bonding of the one or more substrates. Such a step can even be undertaken prior to the forming of any voids within the substrate.

In a further embodiment, reinforcing fibres may be applied to the panel. The step of applying the fibres may include wrapping the panel in such fibres so as to provide additional strength to the structure. This may be particularly beneficial due to the high pressures generated by the exothermic gas producing charge once activated.

The fibres may be applied, for example, before or after the application of a sealing coating. Likewise, the fibres may be applied, for example, before or after the application of a skin layer. In yet another embodiment, the fibres may be applied so that they are within the skin material. It will be appreciated that combinations of the aforementioned embodiments may be used.

The fibres may include one or more materials such as those described above.

In a preferred embodiment, the preparation method comprises the step of forming a profile one or both faces of the panel. For example, one or both faces of the panel may have a profile formed thereon by way of a moulding technique. Where a profiled surface is formed, it is preferably formed on a surface which is visible when the panel is in use. In this way, the aesthetic effect of the panels of the invention may be improved, and the function of the panels may be disguised for aesthetic and security reasons.

In some examples, the preparation method may comprise bonding an outer surface of the panel to a surface effect material. The surface effect material may be selected from those described above.

Such profiling of the outer surface and/or providing of a surface effect material may occur after formation of the panel. However, similar to the process of forming the skin, the step can also occur prior to, for example, bonding of the substrates and/or positioning of the exothermic gas producing charge.

In a further embodiment, the preparation method may comprise the step of sealing the channels of the panel. Such a sealing step may take place at any stage during the formation of the panel. The methods used are known in the art and may be readily selected, as appropriate, by persons of skill in the art.

Depending on the type of exothermic gas producing charge which is used in the panels of the present invention, the charge may produce minor amounts of toxic and/or corrosive substances. Such substances may include ammonia, carbon monoxide and carbon dioxide.

In a preferred embodiment, the method of preparing a panel in accordance with the invention further comprises the step of applying an adsorbent material which can be used to selectively remove the toxic and/or corrosive substances produced before the fire suppressant gas is ejected from the panel.

Suitable materials include those described above.

The absorbent material may be applied to the void so as to remove the toxic and/or corrosive substances as they are produced. Alternatively, or in addition, the absorbent material may be applied within the channels.

Where the substrate is porous, the absorbent material may be retained in the pores of the substrate.

The absorbent material may also be applied to a porous material, different to the substrate. In such an embodiment, the preparation method comprises the step of applying the porous material different to the substrate within the void and/or channels. The porous material may be retained in place by use of known means such as, for example, an adhesive.

Alternatively, or in addition, the method for preparing a panel in accordance with the present invention may comprise the step of adding a filter. The filter may be located in the void (or voids) and/or channels (or channels).

Whilst the exothermic gas producing charge can, in principle, be activated by the high temperatures of a fire, it is preferred for the panel to comprise an igniter for the exothermic gas producing charge. Accordingly, the preparation method also comprises the step of supplying an igniter for the exothermic gas producing charge. Such a step may be undertaken at any suitable point in the method of producing a panel in accordance with the present invention.

In another aspect, the present invention is directed to a method of producing a fire suppression system comprising the steps of:

(i) providing a panel substantially as described above;
(ii) providing a detector and means for activating the panel; and
(iii) connecting the panel to the detector and means for activating the panel.

In a further embodiment of the present invention, the skin may comprise or consist of exothermic gas producing material. In this way, the skin of the panel is able to produce fire suppressing gas, for example, when the skin comes into contact with a fire thereby combusting the material. In addition, it is even contemplated that the skin may comprise of enough exothermic gas producing material that an internal charge is unnecessary. However, it will be appreciated that the presence of both exothermic gas producing charge in the skin and in an internal charge is preferred as they provide a synergistic effect.

The present invention will now be described by way of example and with reference to the accompanying drawings in which.

Figure 1:
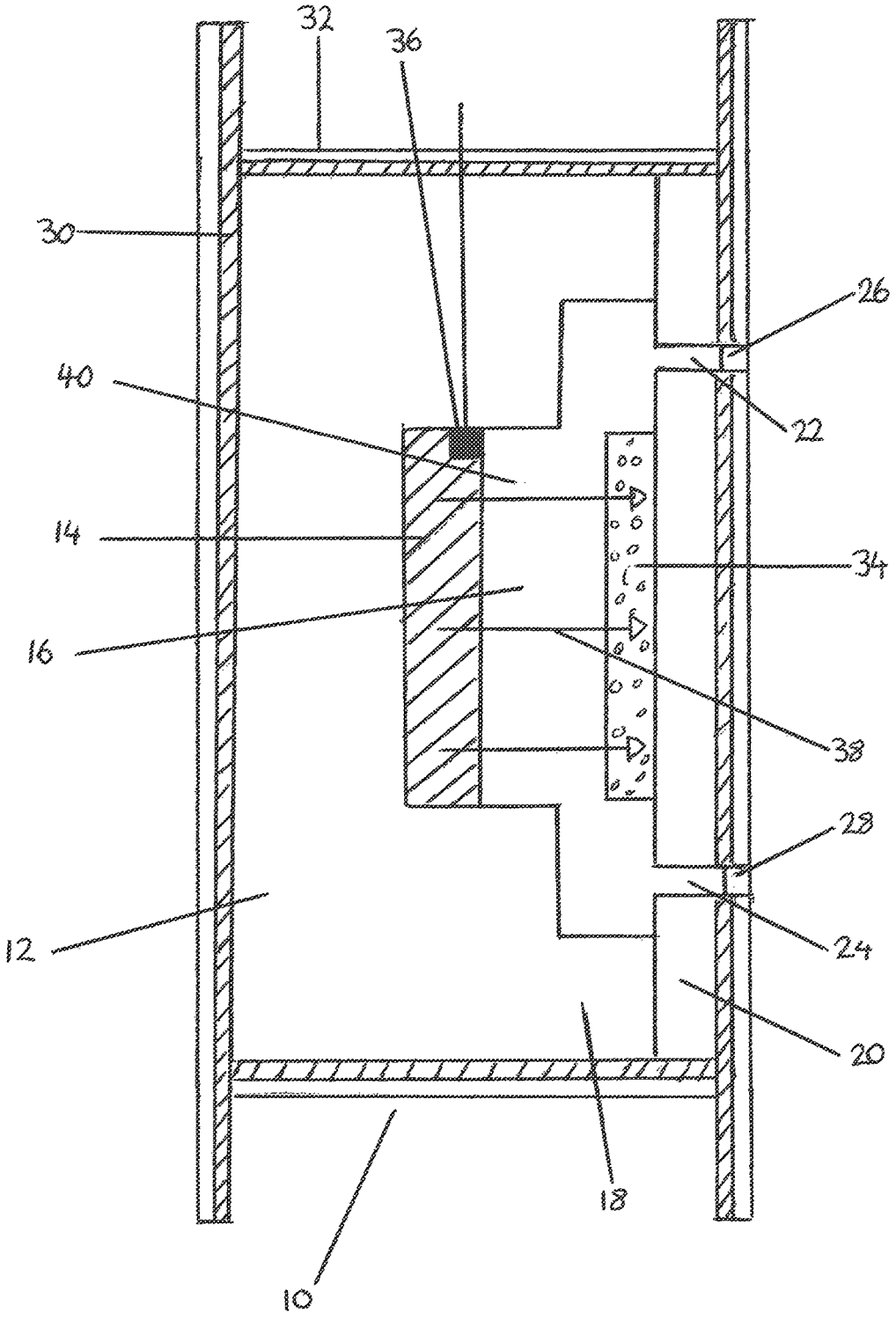
FIG. 1 is a diagrammatic cross-section though a panel in accordance with the present invention.

Looking at FIG. 1, there is provided a panel (10) for use as a fire suppressing system comprising a substrate (12) and an exothermic gas producing charge (14).

In the present example, the substrate (12) is a foamed phenolic resin which is porous in nature.

The substrate (12) defines a void (16) in which exothermic gas producing charge is retained. The void (16) in FIG. 1 is defined by a substrate formed from two parts (18 and 20—both of which are foamed phenolic resins).

The panel (10) further comprises channels (22) and (24) which are in fluid communication with the void (16) and permit, in use, gas to be ejected out of the panel (10). It will be noted that the channels (22) and (24) are offset from the exothermic gas producing charge (14).

Plugs (26) and (28) are located in the channels (22) and (24) respectively so as to prevent the ingress of any moisture and/or dust.

The panel (10) is covered in a web (30) of carbon fibres so as to provide additional strength to the panel structure. It will be appreciated that the fibres could be general fibres such as chopped strand, continuous filament, woven fabrics such as glass fibres, carbon fibres or even metal filaments so as to provide additional strength to the panel structure.

In addition to the web (30), a skin (32) has been provided on the outer surfaces of the substrate (12) which forms the panel (10).

Further, the part (20) of the substrate (10) comprises a region (34) located in proximity to the exothermic gas producing charge (14). The region (34) comprises suitable substances for removing toxic and/or corrosive substances produced by the exothermic gas producing charge (14). In the example of FIG. 1, the substances are located within the pores of the substrate material.

An igniter (36) is also provided for activation of the exothermic gas producing charge (14).

When activated by the igniter (36), the exothermic gas producing charge (14) rapidly combusts producing a fire surpassing gas (38) shown by the arrows in FIG. 1. The void (16) under such conditions forms a pressure chamber (40) thereby increasing the pressure under which the gas (38) is ejected from the panel (10).

As shown in FIG. 1 the gas (38) produced moves essentially in the direction of the arrows (38) towards the region (34). The region (34) is able to at least partially remove unwanted particulate matter within the gas and/or any removing toxic and/or corrosive substances in the gas.

The gas (38) is ejected from the panel (10) by way of the channels (22 and 24) allowing suppression of a fire (not shown).

Figure 2:
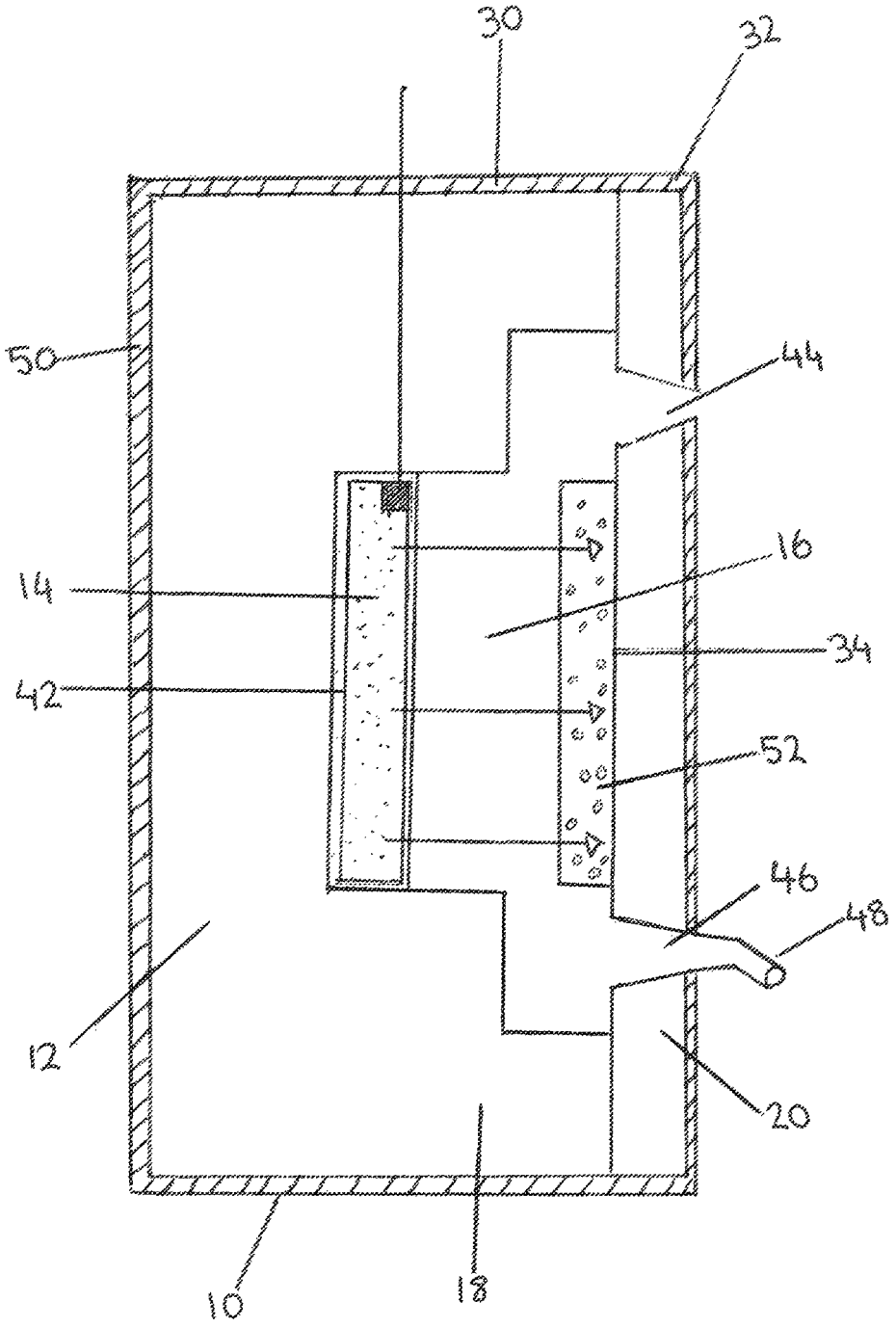
FIG. 2 is a diagrammatic cross-section though a further panel in accordance with the present invention.

FIG. 2 illustrates a further panel (10) in accordance with the present invention. Similar to the embodiment of FIG. 1, the panel (10) comprises a substrate (12) and an exothermic gas producing charge (14). The substrate (12) is a foamed phenolic resin which is porous in nature. The substrate (12) defines a void (16) in which exothermic gas producing charge is retained. The void (16) in FIG. 2 is defined by a substrate formed from two parts (18 and 20—both of which are foamed phenolic resins).

In this embodiment, the exothermic gas producing charge (14) is in the form of a powder, and is retained within an envelope (42) constructed of suitable material.

The panel (10) further comprises channels (44) and (46) which are in fluid communication with the void (16) and permit, in use, gas to be ejected out of the panel (10). It will be noted that the channels (44) and (46) are offset from the exothermic gas producing charge (14).

The channel (44) is tapered such that the channel narrows in a direction away from the void (16). The taper is used as a means of increasing the pressure of the gas produced by the exothermic gas producing charge upon combustion, and thereby increase the distance that the gas will travel on ejection from the panel (10)

The channel (46) is formed from a nozzle (48). The nozzle (48) may be used to direct gas produced by the exothermic gas producing charge upon combustion upon ejection from the panel (10). This allows for directing the fire suppressing gas to particular areas, for example the floor, and/or to improve visibility during the evacuation of a room.

In the embodiment of FIG. 2, the web (30) of carbon fibres is located within the skin (32) on the outer surfaces of the substrate (12) which forms the panel (10) so as to create an impregnated structure (50).

Further, the part (20) of the substrate (10) comprises a region (34) located in proximity to the exothermic gas producing charge (14). The region (34) comprises a separate porous substrate (52) upon which the suitable substances for removing toxic and/or corrosive substances produced by the exothermic gas producing charge (14) have been positioned.

In the example of FIG. 1, the substances are located within the pores of the separate substrate (52).

Figure 3:
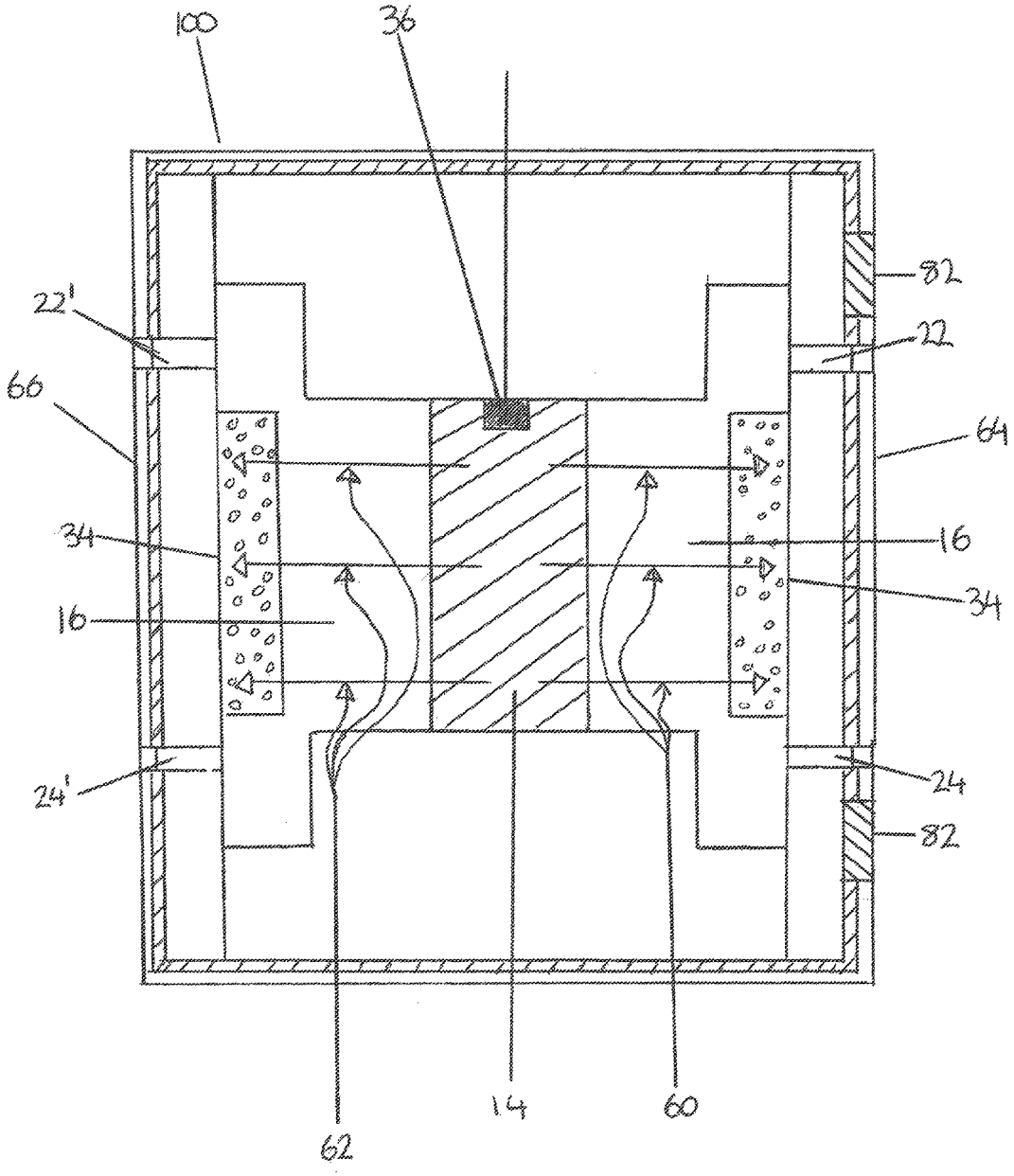
FIG. 3 is a diagrammatic cross-section though a panel in accordance with the present invention wherein the panel has channels on opposite sides.

FIG. 3 shows a panel (100) in accordance with the present invention, which would be suitable for use, for example, within a hung ceiling.

The panel is based on the structure of the panel (10) in FIG. 1, as reflected by the numbering of the structures within FIG. 3.

In contrast to FIG. 1, the embodiment of FIG. 3 comprises two voids (16), two regions (34) and two sets of channels (22 and 24; and 22' and 24' respectively). Whilst only a single exothermic gas producing charge (14) is present, it will be appreciated that at least two or more could be present.

In the embodiment of FIG. 3, the igniter (36) may be used to combust the exothermic gas producing charge (14) in such a way that gas is produced on opposite sides (60 and 62) of the charge.

In this way gas (as shown by the arrows 60 and 62) is ejected from opposite sides (64 and 66) of the panel (100) through the two sets of channels (22 and 24; and 22' and 24' respectively).

It will be appreciated that such an embodiment is particularly applicable for use with a hung-ceiling, where it may be necessary to suppress fires both below and above (i.e. in the ceiling space) the ceiling.

The panel (100) further comprises fans (82) adjacent to the nozzles (22 and 24). The use of fans (82) helps to force the fire suppressant gas generally towards a particular point, for example, the floor to increase visibility for persons in the event of an evacuation. By forcing the initial gas produced towards a lower level, any persons within a room following activation of the panel (100) will have extra time to locate an exit before their view is blocked by the gas.

A power supply (not shown) for the fans (82) may be the detector (not shown) wherein the power supply is maintained only during use of the panel (100).

Figure 4:
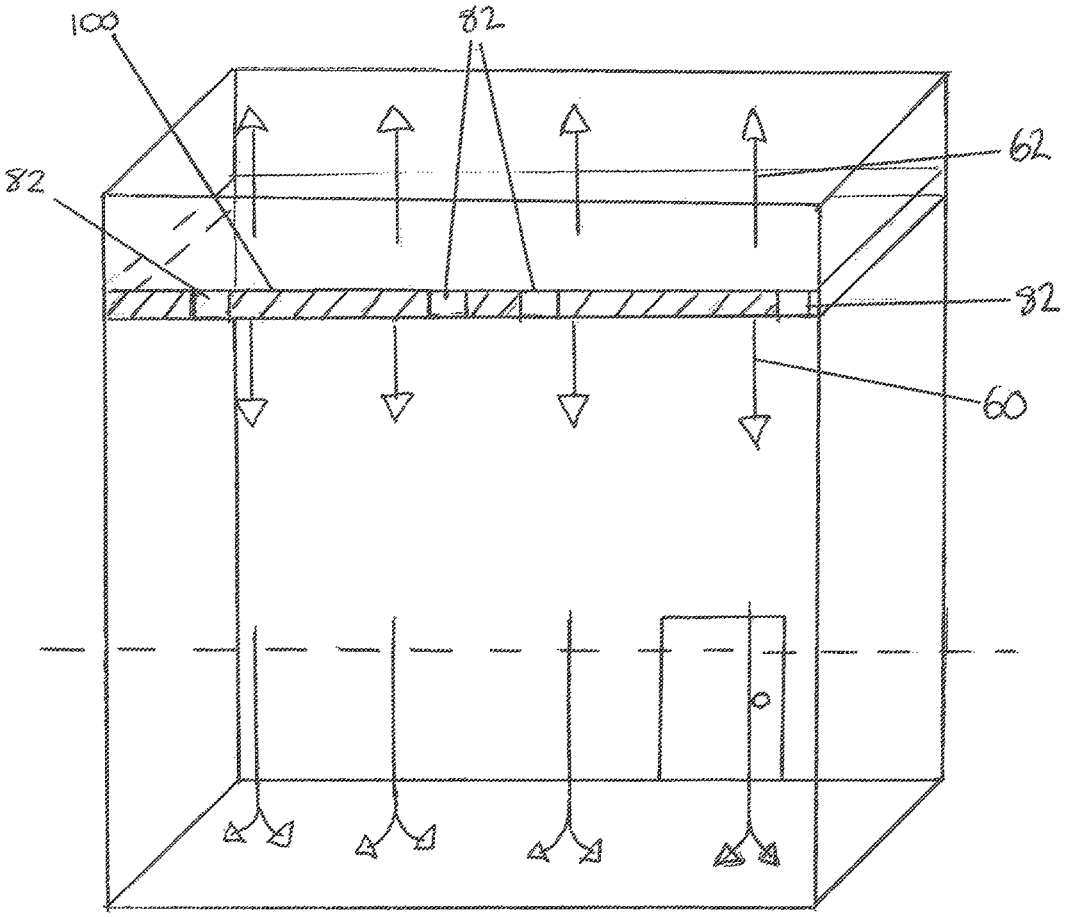
FIG. 4 is a diagrammatic view of a room comprising panels such as described in FIG. 3

FIG. 4 illustrates the use of a fire suppression panel (100) within a room wherein the fire suppressing panels (100) emit the fire suppressant gas both above (62) and below (60) the panels (100).

As shown, the panels further comprises the fans (82) which to help retain the fire suppressant gas generally towards the floor, preferably below eye level.

Figure 5:
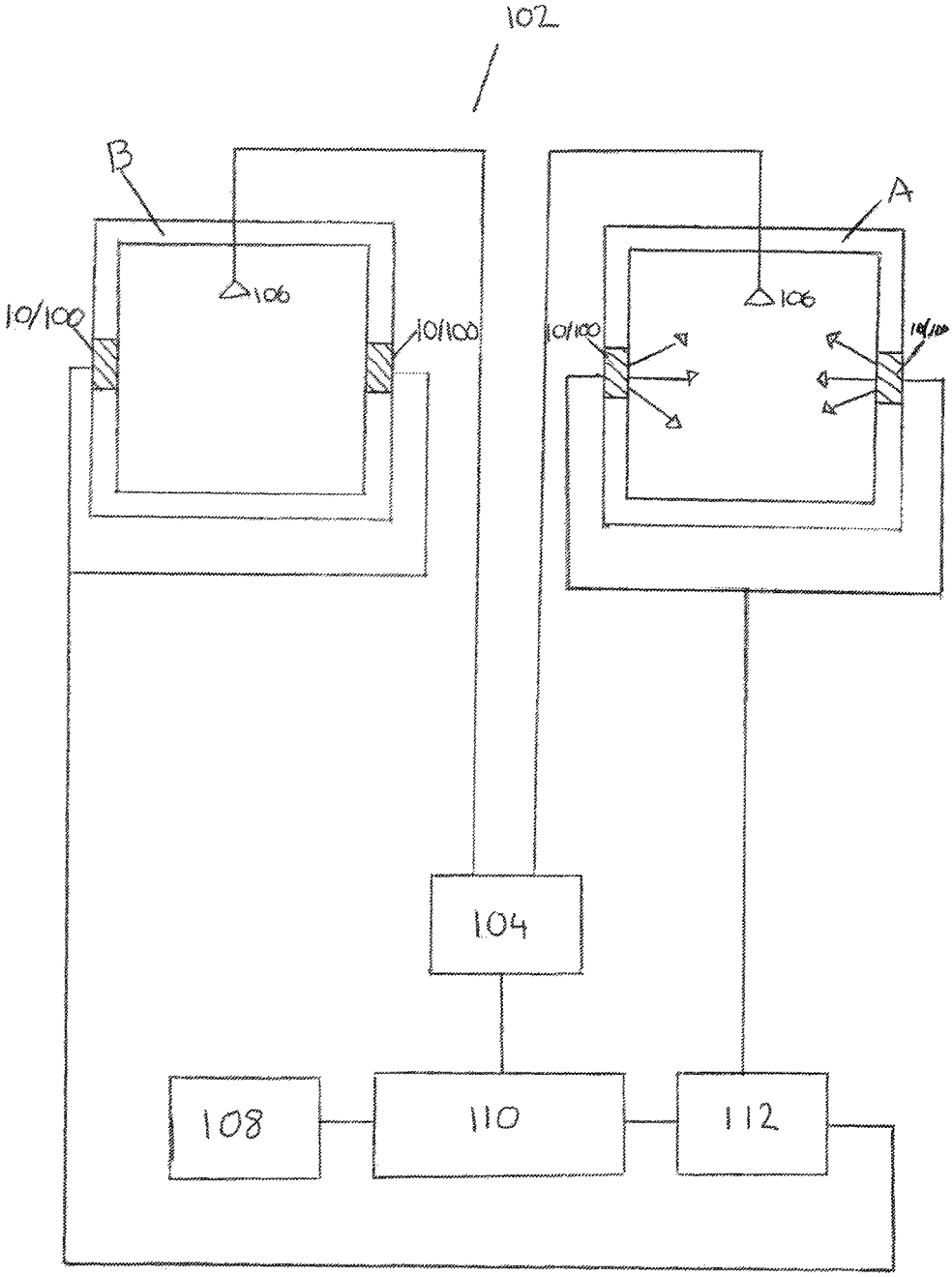
FIG. 5 is a diagrammatic view of a fire suppression system for use with a panel in accordance with the present invention.

FIG. 5 depicts a fire detection system (102) which includes a fire detector system (104) connected to at least one fire detector (106) in each of rooms A and B, a fire alerting system (108), a fire control panel (110) and a fire suppression activating system (112) connected to fire suppression panels (10, 100) directed at the interior of rooms A and B.

The fire detectors (106) detect the presence of smoke, gas or a temperature high than desired in rooms A and B. The fire detector system (102) monitors information received from the fire detectors (104) and determines whether a potential and/or existing condition exists that may indicate a fire and were that fire may be.

The fire detector system (102) communicates with the fire control panel (110). The fire detector system (102) sends the status of each of the fire detectors (104) to the fire control panel (110). The fire control panel (110) is located where it may be monitored by maintenance personnel in a location separate from rooms A and B. The fire control panel (110) controls the fire alerting system (108) and the fire suppression activating system (112).

If the fire detector system (102) determines that a potential and/or existing condition exists that may indicate a fire then the fire control panel (110) emits, via the fire alerting system (108), an audible and/or visual signal indicating a potential and or existing fire. The fire alerting system is connected to speakers (not shown) in the rooms A and B to alert the occupants. Also, the fire control panel (110), via the fire activating system (112), activates the fire suppressing panels (10, 100) where that potential or existing fire may be.

Independent of whether the fire detector system (102) detects a potential and/or existing fire condition, the fire control panel (110) uses fire detector data to display the temperature in rooms A and B on the fire alerting system (108).

Connections between the fire detector system (102), the fire detectors (106), fire alerting system (108), fire control panel (110) and fire suppression activating system (112) may be hardwired and/or via a wireless link.

Power supplies (not shown) to lighting, air conditioning, mains power sockets etc. in each of rooms A and B pass via the fire control panel (110). In the event of a potential and/or existing fire condition, the fire control, the fire control panel isolates these power supplies from the relevant room. This helps to avoid spread of any fire.

Maintenance personnel may manually activate the fire suppression system (112) with controls located on the fire control panel (110). This is for the purpose of testing. The fire control panel (110) is connected to fire alarm buttons (not shown) in rooms A and B for manual activation of the fire suppression activating system (112) in the event a fire is detected by occupants before the fire detection system (102).

The fire suppressing panels (10, 100), shown in FIG. 4, are those described above. Two such panels are shown in each of rooms A and B. Optionally, the panels could be used to construct rooms A and B. Optionally, extra fire suppressing panels (10, 100) may be located in the wall, the ceiling and/or the floor.

The fire suppressing panels (10, 100) are configured to refrain from release of gas into a room while supplied by power and deactivated by the fire suppression activating system (112) (under the control of the control panel (110)). The fire suppressing panels (10, 100) release gas when activated by the fire suppression activating system (112) or, as a fail-safe feature, when power supply is cut.

Figure 6:
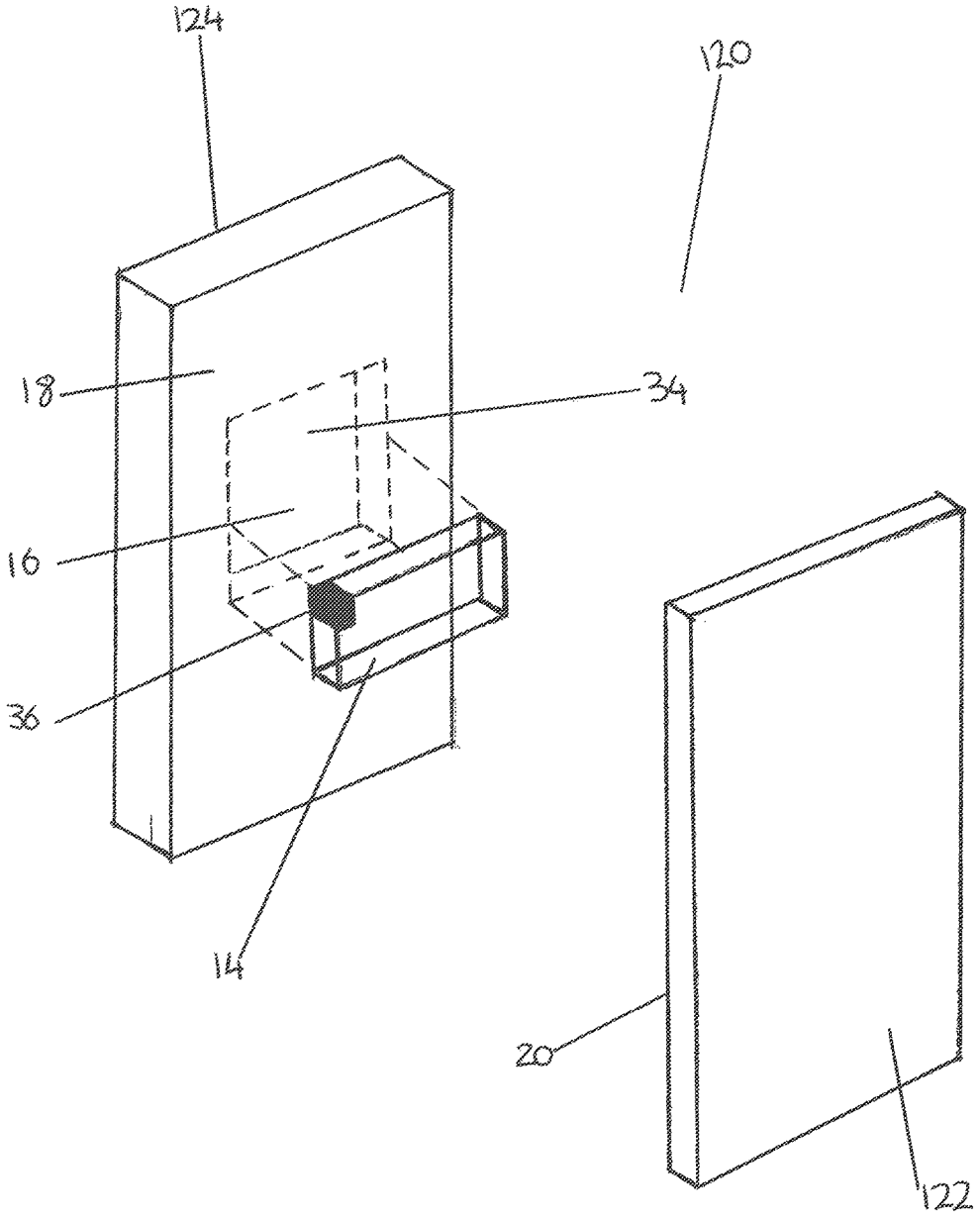
FIG. 6 is an exploded diagrammatic view of a panel in accordance with the present invention.

FIG. 6 shows an exploded view of a fire suppression panel (120), which may be used to form, for example, a door.

The panel (120) comprises substrates (18 and 20) which comprise external skins (122 and 124) which are moulded to resemble the external appearance of, for example, a door.

In the present example, the substrate (18) comprises channels (not shown), through which fire suppressant gas may be released. The substrate (18) defines a void (16) into which the exothermic gas producing charge (14) is placed. A region (34) is also provided and contains suitable substances for removing toxic and/or corrosive substances produced by the exothermic gas producing charge (14).

The panel (120) is formed by bonding of the substrates (18) and (20) such as by use of an adhesive and pressure. Bonding of the substrates is used to create an air-tight seal.

Figure 7:
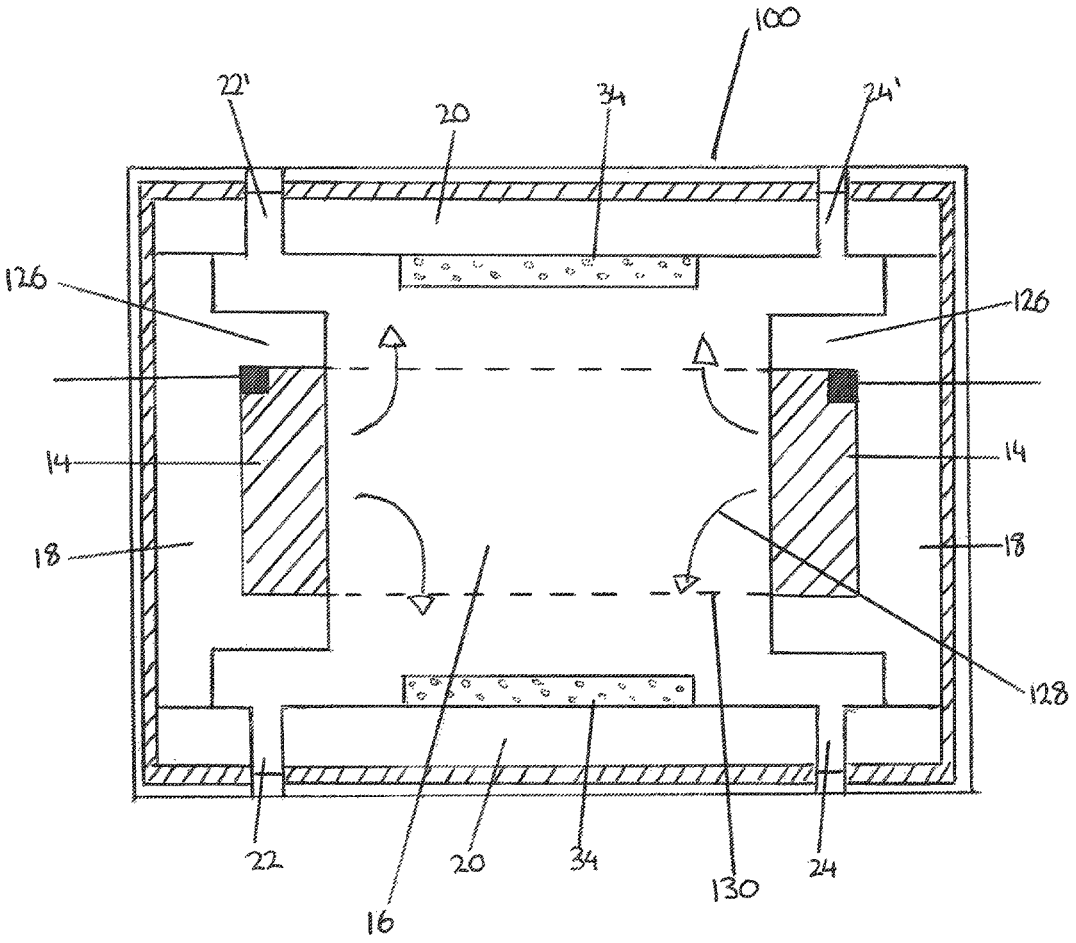
FIG. 7 is a diagrammatic cross-section through a further panel, having channels on opposite sides, in accordance with the present invention.

FIG. 7 illustrates an alternative embodiment of a panel (100) in accordance with the present invention, which would be suitable for use, for example, as a hung ceiling. Similar to the embodiment disclosed in FIG. 3, the panel (100) comprises two sets of channels (22 and 24; and 22' and 24' respectively) and two regions (34).

The panel (100) further comprises a foamed phenolic resin substrate (18) which comprises two sections (126) which are shaped to retain exothermic gas producing charge (14). In the present embodiment there are two separate charges (14).

As can be clearly seen, once activated, the fire suppressing gas produced (128), as shown by the arrows, flows into the void (16) within the panel (100). Under such conditions the void (16), formed from by the substrates (18 and 20), becomes a pressure chamber (130).

The fire suppressing gas (128) which builds up within the void (16) is dispersed through the channels (22, 24 and 22', 24').

As before, the phenolic resin (20) further comprises a region (34) wherein particulate, toxic and/or corrosive matter produced through the exothermic reaction of the charge (14) can be at least partially removed from the fire suppressing gas before it is ejected from the panel (100).

An advantage of the embodiment of FIG. 7 is that the exothermic gas producing charge (14) is retained in place substantially throughout its combustion.

Figure 8:
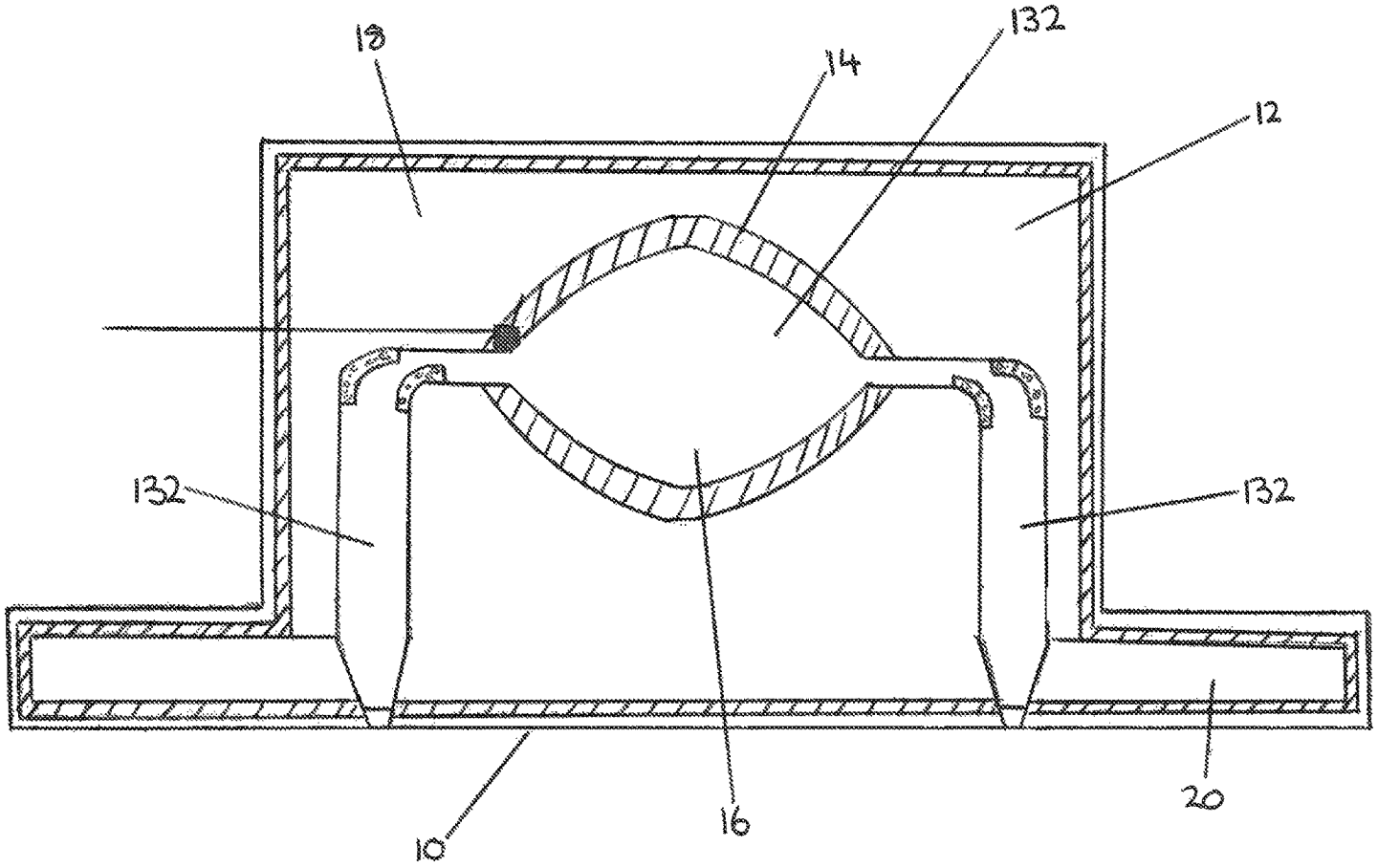
FIG. 8 is a diagrammatic cross-section through a panel in accordance with the present invention, showing an alternative embodiment of pressure chamber.

FIG. 8 discloses an alternative panel (10) in accordance with the present invention.

The panel (10) is similar in structure to the embodiment of FIG. 1 wherein corresponding features have been provided with the same numbering above, for example, the panel (10) comprises a substrate (12) and an exothermic gas producing charge (14).

The substrate (12) is preferably a foamed phenolic resin comprising two parts (18 and 20). The parts (18 and 20) are both shaped such that they cooperatively define a void (16).

The exothermic gas producing charge (14) is retained within pores of the foamed phenolic resin forming the substrate.

As can be clearly seen, the cooperating parts (18 and 20) form a substantially enclosed chamber (132).

Upon combustion of the exothermic gas producing charge (14), the chamber (132) fills with gas (not shown), and due to its shape, reaches temperatures in excess of 850° C.

Gas is ejected in a manner similar to the other embodiments of the present invention.

Figure 9:
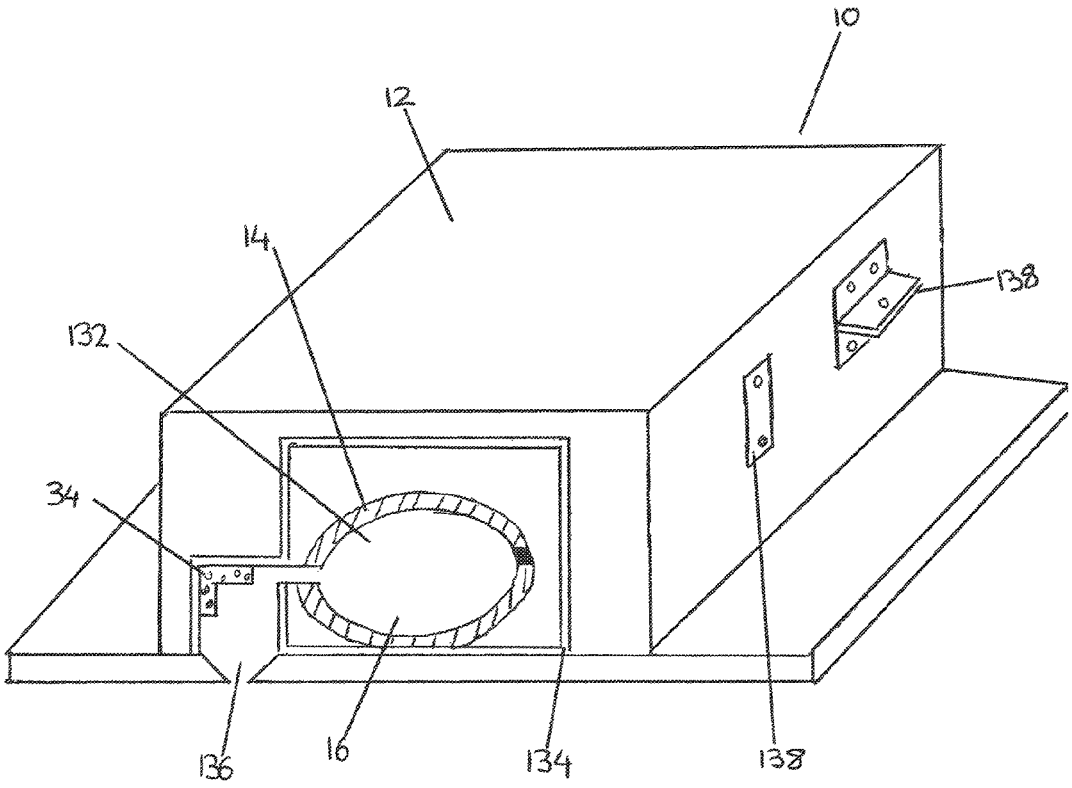
FIG. 9 is a diagrammatic cross-section through a panel in accordance with the present invention, showing the use of a reinforcing casing.

FIG. 9, discloses an embodiment of a further panel (10) in accordance with the present invention. The panel (10) is similar to the panel exemplified in FIG. 8.

The panel (10) comprises a substrate (12) and an exothermic gas producing charge (14). The substrate (12) preferably comprises a foamed phenolic resin.

The panel further comprises a metal casing (134). The casing (134) is positioned and shaped so as to substantially surround the chamber (132).

When the chamber is positioned within the substrate, it will be appreciated that there is substrate material both inside and outside the casing (134) as shown in FIG. 9.

The metal casing (134) is used to provide additional reinforcing means to the panel (10) due to the high pressures created during combustion of the exothermic gas producing charge (14) within the chamber (132).

The panel (10) of FIG. 9 comprises a single channel (136) wherein the channel is tapered to increase the pressure of the fire suppressing gas and therefore increase the ejection distance achieved.

The panel (10) also comprises fixing clips (138) which are used to provide a means for attachment when the panel (10) is in use.

Figure 10:
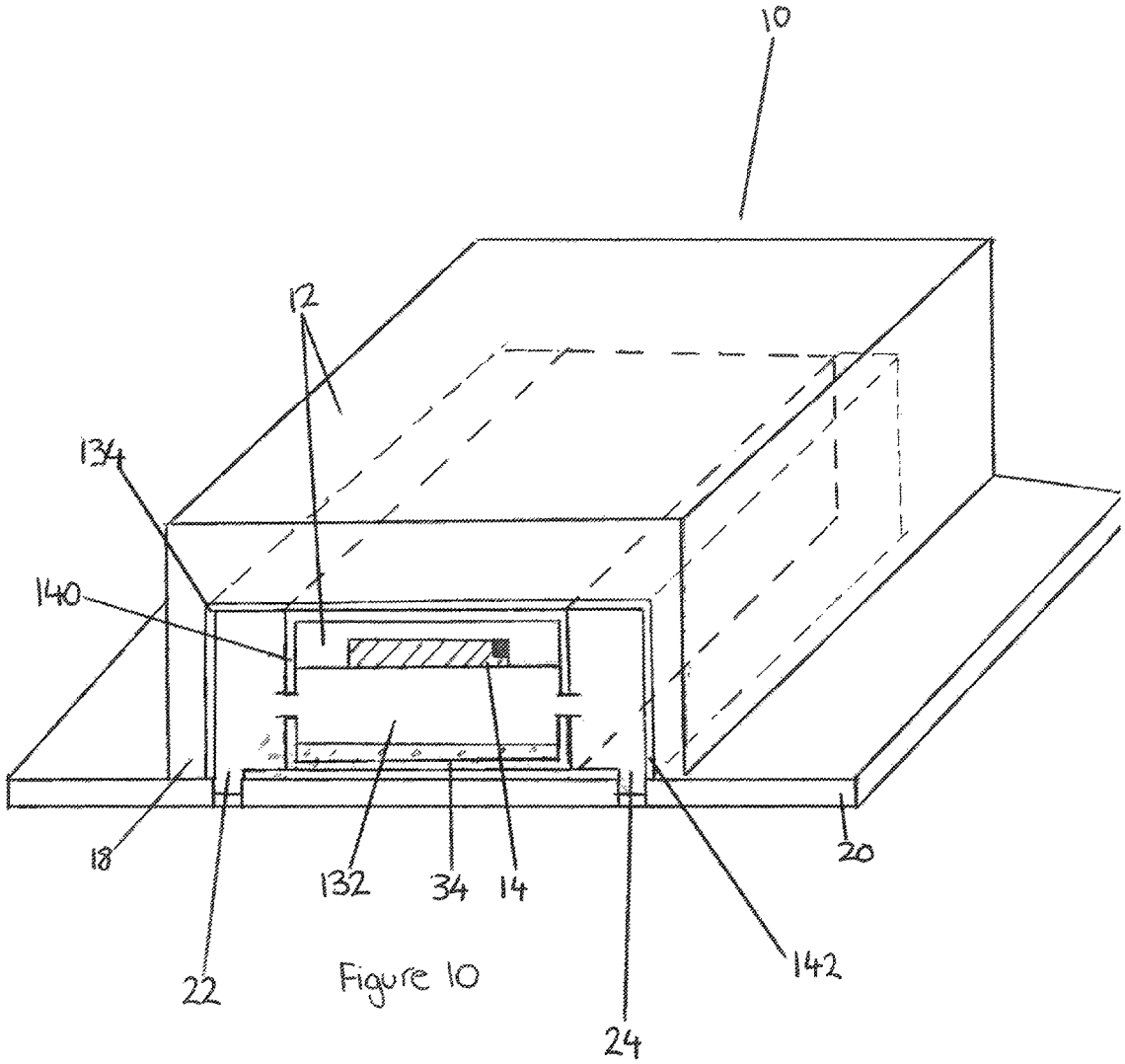
FIG. 10 is a diagrammatic cross-section through a panel in accordance with the present invention, showing use of a further type of reinforcing casing.

FIG. 10, discloses yet another example of a panel (10) in accordance with the present invention. The panel (10) is similar to that described in FIG. 9.

Similar to FIG. 9, the panel (10) comprises a substrate (12), an exothermic gas producing charge (14) and a metal casing (134).

In this example, the metal casing (134) comprises two metal casings (140 and 142). The casing (140) is located within the casing (142). More specifically, the casing (140) substantially surrounds the chamber (132) so as to provide reinforcing means.

The casing (142) surrounds the casing (140) so as to provide yet further reinforcing means to the pressure chamber.

In addition, the casings (140 and 142) define channels (22, 24) through which fire suppressing gas can travel. As shown in FIG. 10, the channels are defined by inner walls of the casing (142) and outer walls of the casing (140).

In use, the fire suppressing gas flows through the two channels (22 and 24) defined by the metal casings (140 and 142).

EXAMPLE

A extinguishing system was subjected to a series of tests in accordance with certain specific provisions of the International Standard for condensed aerosol fire extinguishing systems, ISO 15779, 'Condensed aerosol fire extinguishing systems—Requirements and test methods for components and system design, installation and maintenance—General requirements', 2011. The fire extinguishing performance of the system was assessed against selected fire testing provisions of the standard, as follows:

- Wood crib Class A fire (clause D.6.1)
- Heptane pan Class B fire (clause D.6.2)
- Polymethyl methacrylate (PMMA) polymeric Class A fire (clause D.6.3)
- Polypropylene (PP) polymeric Class A fire (clause D.6.3)
- Acrylonitrile-butadiene-styrene polymer (ABS) polymeric Class A fire (clause D.6.3)
- Class A compatible wood crib Class A fire test (clause D.6.4)

The system for the testing incorporated a nominal 1.4×1.6 m spacing of discharge units.

The Gas Testing Facility

The enclosure used for the evaluation of the extinguishing systems had internal dimensions of 8.1 m long by 4.1 m wide and 3.6 m high. The total internal volume was approximately 120 $m^3$. The test enclosure was a steel framed structure raised 0.5 m above the floor constructed in 6 mm steel and having calcium silicate board lining the internal walls and ceiling. Over pressure protection vents were also present in the enclosure.

Instrumentation was added to the test facility in accordance with the specifications of ISO 15779 Annex D, as follows:

- Paramagnetic oxygen analysers at 0.1H, 1 m and 0.9H for measurement of oxygen concentration (where H is the height of the test room)—referred to herein as the low, medium and high analysers, respectively.
- 0-2000 Pascal differential pressure transducer in the test room.
- K-type thermocouples to measure the temperature 100 mm above the test object height and at 0.9H.
- K-type thermocouple to measure the enclosure temperature at half the room height 1 m from the centre of the floor.
- K-type thermocouples to measure the temperatures of a discharge outlet of each of the aerosol generators.

Additional instrumentation was added as follows:

- Carbon monoxide and carbon dioxide concentration monitoring at mid room height.
- Additional temperature measurements in the room and above the fire location.
- Pressure and temperature in the exhaust duct.

The fuel load mass (loss) during fire testing.

All measurement readings were continuously recorded on a data logging system for the duration of each test.

Extinguishing System Arrangements

Figure 11:
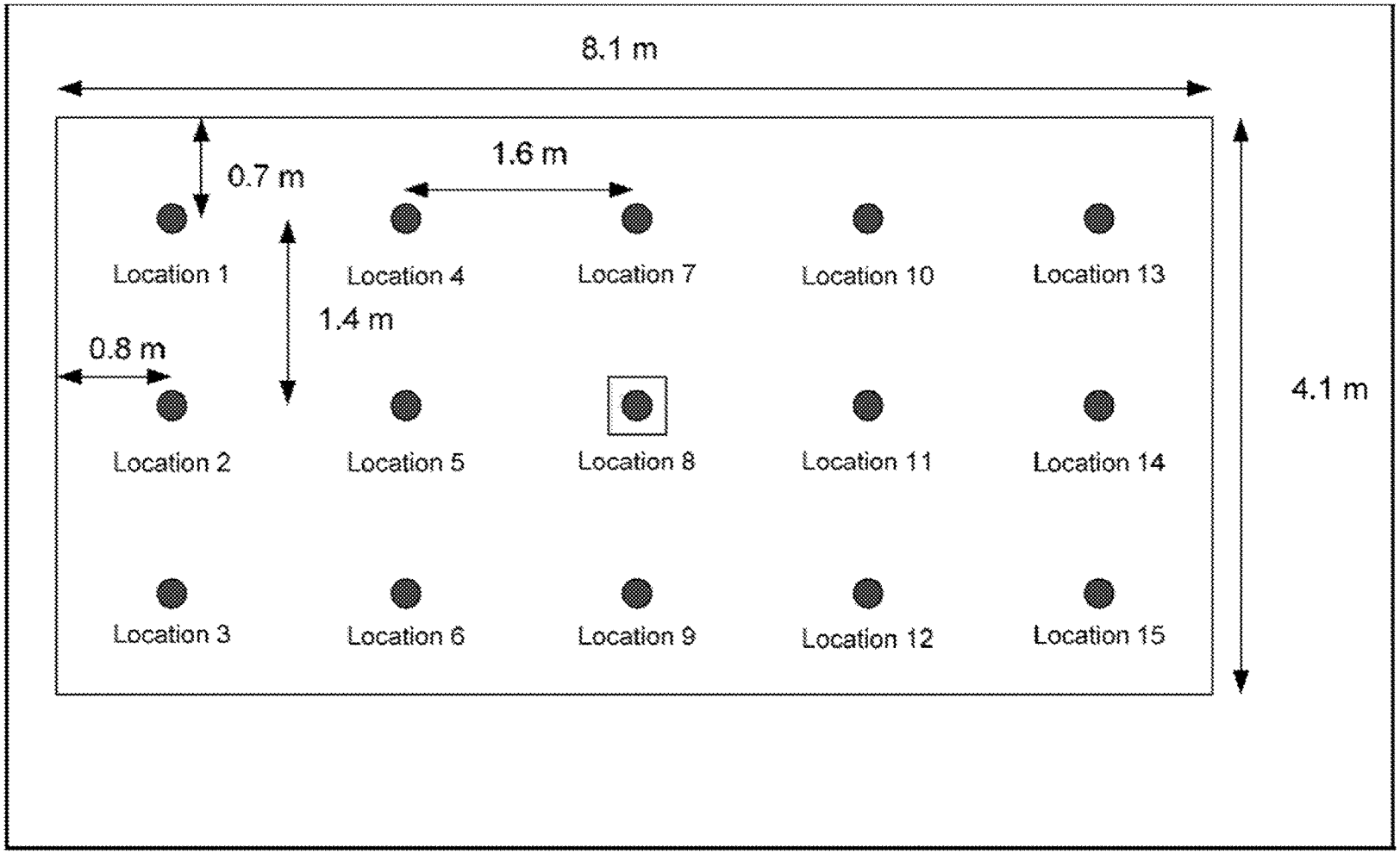
FIG. 11 is schematic diagram showing the approximate position of discharge units installed in a test room.

A schematic diagram showing the approximate position of the discharge units installed in the test room is shown in FIG. 11.

The discharge units included a solid foam base used as a bed for the exothermic gas producing charge, which was in the form of a powder. For ease of testing, discharge outlets were provided in a metal plate located proximate to the exothermic gas producing charge. Electrical igniters were provided to initiate a combustion process in the powder. The igniters comprised a small fusehead providing an explosive charge when an electrical current was applied to the connecting wires. Alarm cable wiring connected the electrical igniters cable and batteries. Up to 15 of the discharge units were used in each test.

Test Programme

The test programme consisted of the following fire tests:

ISO polymeric sheet Acrylonitrile-Butadiene-Styrene (ABS) extinguishing concentration test ISO heptane pan extinguishing concentration test ISO compatible wood crib extinguishing concentration test ISO wood crib extinguishing concentration test ISO polymeric sheet polymethyl methacrylate (PMMA) extinguishing concentration test ISO polymeric sheet polypropylene (PP) extinguishing concentration test All tests were undertaken to the specific relevant requirements of ISO 15779 Annex D as appropriate. After discharge of the system there was a 10 minute 'hold time' where the contents of the room remained sealed before forced ventilation of the space was commenced.

The calculation of agent concentration was determined from the mass of powder installed in each discharge unit, using the following formula:

$$\text{Agent concentration}(g/m^3)=\text{total mass of powder inserted into all activated units}(g)/\text{room volume}(m^3)$$

Testing to ISO 15779 requires that the discharge of aerosol be a maximum of 90 seconds. Thermocouple measurements were used to determine approximate discharge times.

ISO 15779 specifies that 'jet energy from the discharge outlets shall not influence the development of the fire. Therefore, the discharge outlets shall be directed away from the fires'. For unbaffled fires (the wood crib and heptane pan) the discharge unit directly above the centrally positioned fire was therefore removed from the system.

The wood crib pre-burn inside the test room was carried out as per the specification in the most recent version of ISO 14520 as of 6 Mar. 2012, rather than the earlier version of ISO 14520, the text of which was adapted in ISO 15779. It was necessary to open a large over pressure protection vent in the test room ceiling to maintain the oxygen concentration during the pre-burn period, therefore, it was not possible to install a discharge unit in Location 15 (see FIG. 11) for the test.

Findings

A total of 7 fire tests were carried out. Table 1 provides a summary of the results.

TABLE 1

| Test | Scenario | No. of units discharged and quantity (grams) | Max room pressure (Pa) | Min oxygen (%) | Max carbon monoxide (ppm) | Extinguishing time[1] (s) | Concentration of aerosol[2] ($g/m^3$) |
|---|---|---|---|---|---|---|---|
| 1 | Polymeric sheet (ABS) | 9 @ 145 | 72 | 18.49 | >3000 | Not extinguished | 10.9 |
| 2 | Polymeric sheet (ABS) | 13 @ 500 | 370 | 20.45 | 1239 | ~10 | 54.2 |
| 3 | Heptane pan[3] | 10 @ 500 | 320 | 19.44 | 1391 | ~36 | 41.7 |
| 4 | Compatible wood crib[4] | 13 @ 500 | 432 | 20.05 | 1474 | ~20 | 54.2 |
| 5 | Wood crib | 11 @ 500 | 313 | 19.33 | >3000 | Not extinguished | 45.8 |
| 6 | Polymeric sheet (PMMA) | 13 @ 500 | 437 | 20.50 | 1229 | ~20 | 54.2 |
| 7 | Polymeric sheet (PP) | 12 @ 500 | 374 | 20.58 | 1050 | ~10 | 50.0 |

[1]Extinguishing times stated have been measured from the start of system operation. The times are based on thermocouple measurements taken directly above (or in) the test fires.

[2]The stated concentration (for successfully extinguished tests) is the extinguishing concentration for the relevant fuel. According to ISO 15779, this should be subject to verification by means of 3 successful test results for each fire scenario.

[3]Four heptane test cans positioned in the corners of the room (two at high level, two at low level) were all extinguished within approximately 10 s of the onset of activation of the system.

[4]ISO 15779 clause D.6.4 Class A compatible wood crib test specifies two wood crib fires. One of the wood cribs is 'to be placed behind a baffle installed between the floor and ceiling the baffle is to be perpendicular to the direction of nozzle discharge'. Due to the multiple discharge outlet design of the system, it was not appropriate to include this crib in the test (the crib would have been exposed to direct application from discharge units above).

It can be seen from Table 1 that the discharge units successfully extinguished the fires in the heptane pan, compatible wood crib, PMMA and PP tests. The fire in the ABS test was successfully extinguished when the amount of material discharged was increased. The wood crib was not successfully extinguished in test 5. It is worth noting that the discharge unit directly above the centrally positioned fire was removed for this test—had this unit been present then the fire extinguishing performance of the system would have likely been enhanced.

Further observations from the tests are discussed in the following sections:

Discharge times

Figure 12:
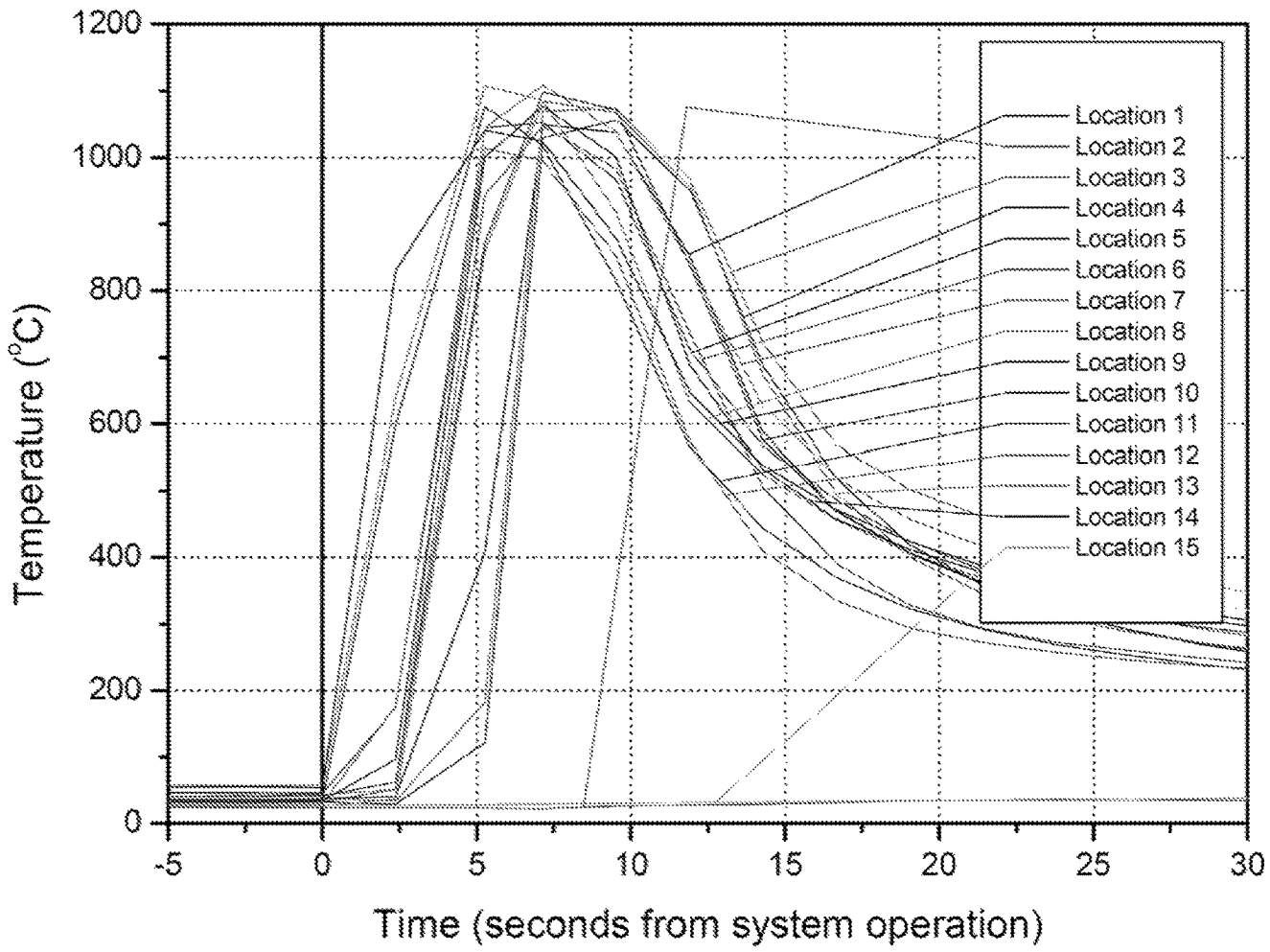
FIG. 12 is a graph showing a typical profile of the temperature measured at one of the discharge outlets on each of the units during testing.

The effective discharge time of aerosol from the units was difficult to determine accurately. Due to the obscuration caused by the discharge it was not possible to define the discharge time from visual or video records. Measurement of temperature at the discharge outlet of the units indicated peak temperatures in excess of 1000° C.

approximately 5 seconds after discharge was initiated. Temperatures began to decline quickly after approximately 8 seconds and had reached a level below 400° C. after about 25-30 seconds. A typical profile of the temperature measured at one of the discharge outlets on each of the units is shown in FIG. 12. The temperatures measured at the discharge outlets of the units were in the region of 150° C. 10 minutes after activation.

Room temperatures

Figure 13:
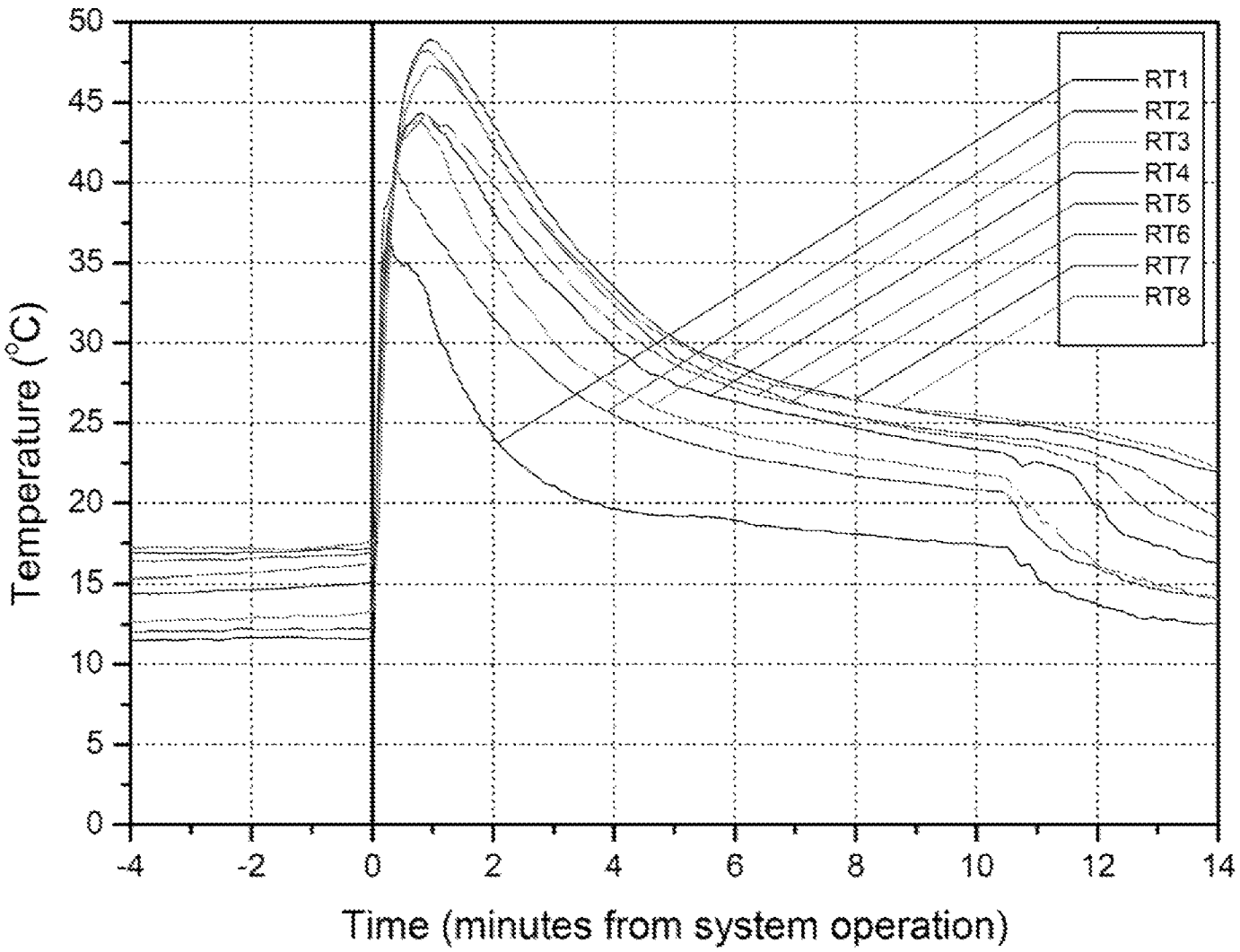
FIG. 13 is a graph showing an increase in temperature of a test room during testing.

As the test room was flooded with the aerosol an increase in the room temperatures was observed. This is illustrated in FIG. 13. Thermocouples were located in a quarter position in the room and spaced from the floor (RT1) up to the ceiling (RT8) in 0.5 m intervals. As an example, in Test 7, the average temperature in the room prior to activation of the system was 14.9° C.; this was increased to 43.4° C. one minute after discharge (a 28.5° C. temperature increase). The increase in room temperature resulted in a buoyant aerosol within the room which was observed to rise out of the door when ventilation of the space was commenced 10 minutes after discharge.

Discharge aerosol energy, fire baffling and unit array

Upon activation of the discharge units the aerosol was discharged directly downwards to floor level with sufficient force that when it hit the floor (or another obstruction) the momentum of the aerosol discharge was 'deflected' and 'bounced up' which quickly resulted in mixing and complete coverage of the entire test room. The rapid room coverage was aided by the multiple discharge points. The design also meant that there was no position in the room (or for a fire to be located) that was more than ~1.5 m from an aerosol discharge point. The ISO 15779 standard states that 'measures shall be taken to avoid effects of blowing out the fire' and the 'jet energy from the discharge outlets shall not influence the development of the fire'. This was difficult to verify, or otherwise, in the tests conducted. However, any such similar discharge design (employing the same spacing of units for a protected space) in an actual system would of course benefit from aerosol discharge in the vicinity of a fire, wherever located.

Figure 14:
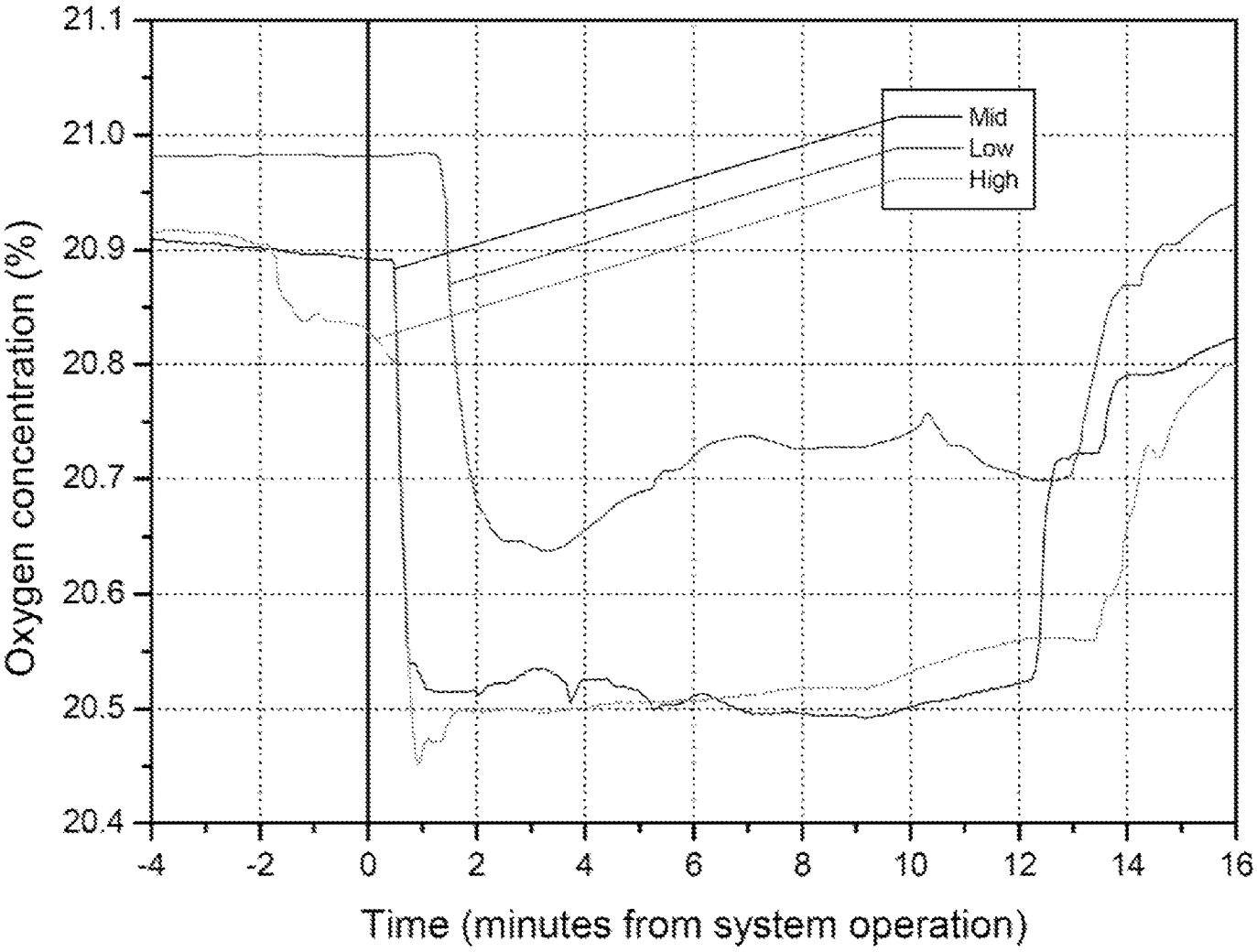
FIG. 14 is a graph showing a decrease in oxygen concentration in a test room during testing.

FIG. 14 shows how the oxygen concentration in the room varied during the ABS test in which a greater amount of material was used, as measured using the low, medium and high analysers. The graph shows that oxygen concentration dropped with discharge. The greatest reduction in concentration is observed at the high analyser, presumably due to its proximity to the discharge units. However, over the course of the discharge, a comparable concentration was observed at the medium analyser, and a noticeable drop was observed at the low analyser. This shows that the aerosol used in the experiment spreads through the room to provide coverage at all analyser heights.

Room pressure on system discharge

The measured peak room over pressure in the test room upon activation of the system ranged from 72 Pascals to 437 Pascals. A small under pressure (less than 25 Pascals) was observed in some tests approximately 15 seconds after initiation of the discharge. Aerosol was recorded discharging through an over pressure protection vent installed in the door.

Obscuration/visibility

Video recordings taken from inside the room during the test programme showed that complete obscuration resulted a few seconds after the onset of discharge. Visibility from the camera was reduced to a short distance and 'total whiteout' was observed. Visibility from the camera (at a height of approximately 1 m from the floor) did not improve significantly until after ventilation of the space was commenced 10 minutes after discharge.

The invention claimed is:

1. A fire suppression panel, the panel comprising:

a polymeric foam substrate; and an exothermic gas producing charge, wherein the exothermic gas producing charge is integral with the polymeric foam substrate.

2. The panel according to claim 1, wherein the polymeric foam substrate comprises an open cell foam.

3. The panel according to claim 1, wherein the polymeric foam substrate has a tensile strength in the range of about 80 to about 100 kg/m$^3$.

4. The panel according to claim 1, wherein the polymeric foam substrate further includes one or more of zeolites, porous titania material, ceramic material, sintered metals and silicon carbide.

5. The panel according to claim 1, wherein the polymeric foam substrate comprises a phenolic resin.

6. The panel according to claim 1, wherein the exothermic gas producing charge comprises potassium nitrate.

7. The panel according to claim 1, wherein the exothermic gas producing charge comprises at least one of: a binder, burn rate modifier, flame inhibition chemical and an additional oxidizing agent.

8. The panel according to claim 1, wherein the exothermic gas producing charge is positioned within a void formed in the polymeric foam substrate, and wherein the void is a substantially enclosed cavity or chamber within the polymeric foam substrate of the panel.

9. The panel according to claim 8, wherein the polymeric foam substrate comprises a plurality of voids, and wherein one or more of the plurality of voids contains the exothermic gas producing charge.

10. The panel according to claim 9, wherein the voids are distributed in a two-dimensional array in a direction perpendicular to the panel thickness.

11. The panel according to claim 8, wherein an internal surface of the void comprises a heat resistant material selected from at least one member of a group consisting of: rock wool, gypsum, perlite, vermiculite, alumina, aluminum hydroxide, magnesium hydroxide, and calcium silicate.

12. The panel according to claim 1, wherein the panel comprises at least one channel such that gas produced by the exothermic gas producing charge can be ejected from the panel.

13. The panel according to claim 12, wherein at least one nozzle is used to provide the at least one channel within the polymeric foam substrate.

14. The panel according to claim 12, wherein at least one nozzle is used in addition to the at least one channel within the polymeric foam substrate.

15. The panel according to claim 14, wherein the at least one channel is positioned so as to direct gas produced by the exothermic gas producing charge in a particular direction.

16. The panel according to claim 14, wherein the at least one channel is shaped so as to control the pressure of gas produced by the exothermic gas producing charge.

17. The panel according to claim 12, wherein the at least one channel is offset from the exothermic gas producing charge.

18. The panel according to claim 1, wherein the panel is sealed to prevent unwanted ejection of gas from the exothermic gas producing charge.

19. The panel according to claim 1, wherein the panel is substantially coated in a skin, wherein the skin is formed from sheet-form polymeric material of gypsum.

20. The panel according to claim 1, further comprising at least one reinforcing layer.

21. The panel according to claim 20, wherein the at least one reinforcing layer is located within a skin which substantially coats the panel.

22. The panel according to claim 1, wherein at least one face of the panel has a profiled surface.

23. The panel according to claim 1, wherein an outer surface of the panel is bonded to a surface effect material, wherein the surface effect material is selected from a simulated stone surface, a simulated brick surface, a simulated wood surface, a wood laminate surface, a material of high thermal conductivity (a "cool touch" surface) and a reflective surface.

24. The panel according to claim 1, further comprising an absorbent material to remove at least one member of a group consisting of: toxic substances produced by combustion of the exothermic gas producing charge or corrosive substances produced by combustion of the exothermic gas producing charge.

25. The panel according to claim 1, further comprising a filter positioned to filter gas produced by the exothermic gas producing charge.

26. The panel according to claim 1, further comprising an igniter for igniting the exothermic gas producing charge.

27. The panel according to claim 1, further comprising a fan.

28. The panel according to claim 1, wherein the panel is modular.

29. A fire suppression system comprising a panel according to claim 1, the system further comprising:

a fire detection system connected to the panel, the fire detection system comprises a sensor and means for activating the panel.

30. A shield for use in fire suppression comprising a panel according to claim 1.

31. A method of preparing a panel in accordance with claim 1, comprising the steps of:

(i) providing a polymeric foam substrate;

(ii) forming a void therein; and (iii) positioning an exothermic gas producing charge within the void.

32. The method according to claim 31, further comprising the step of providing at least one further substrate.

33. The method according to claim 32, wherein the at least one further substrate has a void therein which is complementary to the void in the substrate.

34. The method according to claim 31, wherein the exothermic gas producing charge is positioned whilst in the form of a powder, paste or solid.

35. A method for producing a fire suppression system comprising the steps of:

(i) providing a panel as described in claim 1;

(ii) providing a detector and means for activating the panel; and (iii) connecting the panel to the detector and means for activating the panel.

* * * * *